US010725411B2

(12) United States Patent
Murakami

(10) Patent No.: US 10,725,411 B2
(45) Date of Patent: Jul. 28, 2020

(54) IMAGE FORMING APPARATUS THAT FORMS AN IMAGE ON A SHEET MEDIUM UNDER AN OPERATION CONDITION SET IN ACCORDANCE WITH A TYPE OF THE MEDIUM

(71) Applicant: KONICA MINOLTA, INC., Chiyoda-ku, Tokyo (JP)

(72) Inventor: Yusuke Murakami, Okazaki (JP)

(73) Assignee: KONICA MINOLTA INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/408,810

(22) Filed: May 10, 2019

(65) Prior Publication Data

US 2019/0354050 A1 Nov. 21, 2019

(30) Foreign Application Priority Data

May 18, 2018 (JP) ..... 2018-096070

(51) Int. Cl.
*G03G 15/00* (2006.01)
*G03G 15/16* (2006.01)

(52) U.S. Cl.
CPC ..... *G03G 15/5008* (2013.01); *G03G 15/1615* (2013.01); *G03G 2215/00751* (2013.01); *G03G 2215/0125* (2013.01)

(58) Field of Classification Search
CPC ..... G03G 15/5008; G03G 15/1615; G03G 15/5029; G03G 2215/00751; G03G 2215/00738; G03G 2215/0125
See application file for complete search history.

(56) References Cited

U.S. PATENT DOCUMENTS

2007/0024883 A1* 2/2007 Yoshizawa ..... G03G 15/5029 358/1.13

FOREIGN PATENT DOCUMENTS

JP 2013019946 A 1/2013

* cited by examiner

*Primary Examiner* — Sandra Brase
(74) *Attorney, Agent, or Firm* — Buchanan Ingersoll & Rooney PC

(57) ABSTRACT

An image forming apparatus that forms an image on a sheet medium under an operation condition set in accordance with a type of the medium, includes a hardware processor that: detects which of a plurality of assumed types the type of the medium applies to, based on output from a sensor; and performs control under which, before the type of the medium is detected, shift to a quasi-rise state, in which preparation for image formation under a provisional condition has partially been completed, is performed, the provisional condition corresponding to an operation condition corresponding to one of the plurality of assumed types, and after the type of the medium is detected, shift to a rise state, in which preparation for image formation under a fixed condition has been completed, is performed, the fixed condition corresponding to an operation condition corresponding to the detected type.

17 Claims, 28 Drawing Sheets

FIG. 3

D10

| TYPE NAME | OPERATION CONDITION VALUE | | | |
|---|---|---|---|---|
| | PROCESS VELOCITY Vsys [mm/s] | FIXING TEMPERATURE Ts [°C] | SECONDARY TRANSFER OUTPUT V16 [V] | FOG MARGIN Vm [V] |
| PLAIN PAPER 1 | 290 | 165 | 1600 | 150 |
| PLAIN PAPER 2 | | | 1550 | 160 |
| PLAIN PAPER 3 | | | 1500 | 170 |
| THICK PAPER 1 | 210 | 150 | 1600 | 150 |
| THICK PAPER 2 | | 155 | 1900 | |
| THICK PAPER 3 | 105 | 140 | 1600 | 130 |
| THICK PAPER 4 | | 150 | 1900 | |

Dkp → INITIALLY SET TYPE

Dk

Dc1 Dc2 Dc3 Dc4

Dc

FIG. 6

| | COLOR PHOTOCONDUCTOR 4ymc | INTERMEDIATE TRANSFER BELT 12 SECONDARY TRANSFER ROLLER 16 | MONOCHROME PHOTOCONDUCTOR 4k | PAPER FEEDING CONVEYOR 231 | PRESSURE-CONTACT/ SEPARATION MECHANISM 110 |
|---|---|---|---|---|---|
| CONFIGURATION [1] | COLOR PC MOTOR 54 | MAIN MOTOR 51 | | PAPER FEEDING MOTOR 53 | 110a (K PRESSURE CONTACT/ FULL PRESSURE CONTACT) |
| CONFIGURATION [2] | COLOR PC MOTOR 54 | MAIN MOTOR 51 | | | 110a (K PRESSURE CONTACT/ FULL PRESSURE CONTACT) |
| CONFIGURATION [3] | COLOR PC MOTOR 54 | BELT MOTOR 52 | MONOCHROME PC MOTOR 55 | PAPER FEEDING MOTOR 53 | 110b (FULL SEPARATION/ K PRESSURE CONTACT/ FULL PRESSURE CONTACT) |
| CONFIGURATION [4] | COLOR PC MOTOR 54 | PAPER FEEDING MOTOR 53 | MONOCHROME PC MOTOR 55 | PAPER FEEDING MOTOR 53 | 110b (FULL SEPARATION/ K PRESSURE CONTACT/ FULL PRESSURE CONTACT) |
| CONFIGURATION [5] | COLOR PC MOTOR 54 | BELT MOTOR 52 | MONOCHROME PC MOTOR 55 | | 110b (FULL SEPARATION/ K PRESSURE CONTACT/ FULL PRESSURE CONTACT) |

FIG. 8

D20

| | TYPE NAME | BASIS WEIGHT (DETECTION SIGNAL VALUE) |
|---|---|---|
| Dk | PLAIN PAPER 1 | 60 TO 70 g/m$^2$ |
| | PLAIN PAPER 2 | 71 TO 90 g/m$^2$ |
| | PLAIN PAPER 3 | 91 TO 105 g/m$^2$ |
| | THICK PAPER 1 | 105 TO 120 g/m$^2$ |
| | THICK PAPER 2 | 121 TO 209 g/m$^2$ |
| | THICK PAPER 3 | 210 TO 256 g/m$^2$ |
| | THICK PAPER 4 | 257 TO 271 g/m$^2$ |

FIG. 9

| WHETHER INTERMEDIATE TRANSFER BELT AND PHOTOCONDUCTOR HAVE SAME DRIVE SOURCE | WHETHER PAPER FEEDING CONVEYOR AND PHOTOCONDUCTOR HAVE SAME DRIVE SOURCE | BEFORE CONDITION FIXING (BEFORE DETECTION OF TYPE) | | AFTER CONDITION FIXING | |
|---|---|---|---|---|---|
| | | PRESSURE-CONTACT/ SEPARATION | DRIVE CONTROL FOR PHOTOCONDUCTOR | PRESSURE-CONTACT/ SEPARATION | DRIVE CONTROL FOR PHOTOCONDUCTOR |
| SAME $\alpha$ | SAME $\alpha 1$ | PRESSURE CONTACT | ROTATION AT VELOCITY UNDER INITIALLY SET CONDITION | PRESSURE CONTACT | SWITCHING OF OPERATION CONDITION, OR START-DOWN AND START-UP |
| MONOCHROME PCS IN CONFIGURATIONS (1) AND (2) | MONOCHROME PC IN CONFIGURATION (2) | RISE STATE UNDER PROVISIONAL CONDITION | | | |
| | DIFFERENT $\alpha 2$ | PRESSURE CONTACT | STOP | PRESSURE CONTACT | START-UP |
| | MONOCHROME PC IN CONFIGURATION (1) | QUASI-RISE STATE | | | |
| DIFFERENT $\beta$ | SAME $\beta 1$ | SEPARATION | ROTATION AT VELOCITY UNDER INITIALLY SET CONDITION | PRESSURE CONTACT | SWITCHING OF OPERATION CONDITION, OR START-DOWN AND START-UP |
| MONOCHROME PCS IN CONFIGURATIONS (3) TO (5) COLOR PCS IN CONFIGURATIONS (1) TO (5) | MONOCHROME PC IN CONFIGURATION (5) | QUASI-RISE STATE | | | |
| | DIFFERENT $\beta 2$ | SEPARATION | STOP | PRESSURE CONTACT | START-UP |
| | MONOCHROME PCS IN CONFIGURATIONS (3) AND (4) COLOR PCS IN CONFIGURATIONS (1) TO (5) | QUASI-RISE STATE | | | |

FIG. 10

| WHETHER INTERMEDIATE TRANSFER BELT AND PHOTOCONDUCTOR HAVE SAME DRIVE SOURCE | WHETHER PAPER FEEDING CONVEYOR AND PHOTOCONDUCTOR HAVE SAME DRIVE SOURCE | BEFORE CONDITION FIXING (BEFORE DETECTION OF TYPE) | | AFTER CONDITION FIXING | |
|---|---|---|---|---|---|
| | | PRESSURE-CONTACT/ SEPARATION | DRIVE CONTROL FOR PHOTOCONDUCTOR | PRESSURE-CONTACT/ SEPARATION | DRIVE CONTROL FOR PHOTOCONDUCTOR |
| SAME α<br>MONOCHROME PCS IN CONFIGURATIONS (1) AND (2) | SAME α1<br>MONOCHROME PC IN CONFIGURATION (2) | PRESSURE CONTACT | ROTATION AT VELOCITY UNDER INITIALLY SET CONDITION | PRESSURE CONTACT | SWITCHING OF OPERATION CONDITION, OR START-DOWN AND START-UP |
| | | RISE STATE UNDER PROVISIONAL CONDITION | | | |
| | DIFFERENT α2<br>MONOCHROME PC IN CONFIGURATION (1) | PRESSURE CONTACT | ROTATION AT VELOCITY UNDER OPTIONALLY SET CONDITION | PRESSURE CONTACT | SWITCHING OF OPERATION CONDITION, OR START-DOWN AND START-UP |
| | | RISE STATE UNDER PROVISIONAL CONDITION | | | |
| DIFFERENT β<br>MONOCHROME PCS IN CONFIGURATIONS (3) TO (5) COLOR PCS IN CONFIGURATIONS (1) TO (5) | SAME β1<br>MONOCHROME PC IN CONFIGURATION (5) | SEPARATION | ROTATION AT VELOCITY UNDER INITIALLY SET CONDITION | PRESSURE CONTACT | SWITCHING OF OPERATION CONDITION, OR START-DOWN AND START-UP |
| | | QUASI-RISE STATE | | | |
| | DIFFERENT β2<br>MONOCHROME PCS IN CONFIGURATIONS (3) AND (4) COLOR PCS IN CONFIGURATIONS (1) TO (5) | SEPARATION | ROTATION AT VELOCITY UNDER OPTIONALLY SET CONDITION | PRESSURE CONTACT | SWITCHING OF OPERATION CONDITION, OR START-DOWN AND START-UP |
| | | QUASI-RISE STATE | | | |

FIG. 25A

D31

| RELIABILITY OF DETERMINATION ABOUT USE FREQUENCY | WHETHER TYPE HAVING HIGH FREQUENCY EXISTS | DETERMINATION RESULT (IS NORMAL START-UP TO BE PERFORMED?) |
|---|---|---|
| INSUFFICIENT | --- | NO |
| SUFFICIENT | EXIST | YES |
| | NOT EXIST | NO |

FIG. 25B

D32

| USER CHOICE | TYPE HAVING HIGH FREQUENCY | CONVEYANCE PERFORMANCE | PROVISIONAL CONDITION (DETERMINATION RESULT) |
|---|---|---|---|
| OPTIONALLY SPECIFIED | --- | --- | OPERATION CONDITION FOR SPECIFIED TYPE |
| AUTOMATIC | UNDETERMINED (LACK OF DATA) | HIGH | OPERATION CONDITION FOR PLAIN PAPER 1/2/3 |
| | | LOW | OPERATION CONDITION FOR THICK PAPER 3 (INITIAL SETTING) |
| | THICK PAPER 1/2/3/4 | --- | OPERATION CONDITION FOR TYPE HAVING MAXIMUM FREQUENCY |
| | PLAIN PAPER 1/2/3 | HIGH | OPERATION CONDITION FOR TYPE HAVING MAXIMUM FREQUENCY |
| | | LOW | OPERATION CONDITION FOR THICK PAPER 1 |

FIG. 26A

D33

| USER CHOICE | ENVIRONMENTAL CONDITION | ENDURANCE CONDITION | USE FREQUENCY | DETERMINATION RESULT |
|---|---|---|---|---|
| STOP | --- | --- | --- | STOP |
| DRIVE (ROTATION) | --- | --- | --- | DRIVE |
| AUTOMATIC | --- | LATE STAGE | --- | STOP |
| | LOW TEMPERATURE AND LOW HUMIDITY | --- | --- | STOP |
| | HIGH TEMPERATURE AND HIGH HUMIDITY | --- | --- | STOP |
| | OTHER THAN ABOVE | OTHER THAN ABOVE | UNDETERMINED | STOP |
| | | | REGULAR | DRIVE |
| | | | IRREGULAR | STOP |

FIG. 26B

D34

| RELIABILITY OF DETERMINATION ABOUT USE FREQUENCY | PROVISIONAL CONDITION (DETERMINATION RESULT) |
|---|---|
| INSUFFICIENT | INITIALLY SET CONDITION |
| SUFFICIENT | OPERATION CONDITION FOR TYPE HAVING HIGH FREQUENCY |

FIG. 26C

D35

| DRIVE SOURCE OF PHOTOCONDUCTOR | DRIVE SOURCE OF TRANSFER MECHANISM | TIMING OF MATCHING TO SHEET TYPE FIXATION (DETECTION COMPLETION) |
|---|---|---|
| SINGLE | --- | COMPLETION OF START-UP OF PHOTOCONDUCTOR |
| COMMON WITH THAT OF TRANSFER | --- | SLOW ONE OF COMPLETION OF START-UP OF PHOTOCONDUCTOR AND COMPLETION OF TRANSFER CLEANING |
| --- | SINGLE | COMPLETION OF TRANSFER CLEANING |

FIG. 27

D36

| USER CHOICE | ENVIRONMENTAL CONDITION | ENDURANCE CONDITION | DETERMINATION RESULT |
|---|---|---|---|
| RESTART-UP | --- | --- | RESTART-UP |
| SWITCHING OF CONDITION | --- | --- | SWITCHING OF CONDITION |
| AUTOMATIC | --- | LATE STAGE | RESTART-UP |
| | LOW TEMPERATURE AND LOW HUMIDITY | --- | RESTART-UP |
| | HIGH TEMPERATURE AND HIGH HUMIDITY | --- | RESTART-UP |
| | OTHER THAN ABOVE | OTHER THAN ABOVE | SWITCHING OF CONDITION |

IMAGE FORMING APPARATUS THAT FORMS AN IMAGE ON A SHEET MEDIUM UNDER AN OPERATION CONDITION SET IN ACCORDANCE WITH A TYPE OF THE MEDIUM

The entire disclosure of Japanese patent Application No. 2018-096070, filed on May 18, 2018, is incorporated herein by reference in its entirety.

BACKGROUND

Technological Field

The present invention relates to an image forming apparatus.

Description of the Related Art

An image forming apparatus such as a printer, a copier, and a combined machine includes a sheet table (e.g., a tray or a cassette), in which a plurality of sheets to be used as a recording medium for an image is to be set. The image forming apparatus performs printing by conveying a sheet from the sheet table to a printing position in the apparatus.

A function of setting an operation condition in accordance with the type of the sheet to obtain an appropriate image is known as a function of the image forming apparatus of this type. For example, in an electrophotographic image forming apparatus, a sheet is classified by basis weight, and, for example, conveyance velocity (process velocity), development bias, transfer bias, and fixing temperature are set in accordance with the basis weight. The setting can prevent, for example, jams, development defects, transfer defects, and fixing defects.

Methods in which the image forming apparatus acquires the type of the sheet include a method in which a user selects and specifies the type of the sheet from several options (e.g., plain paper, thick paper 1, and thick paper 2). The image forming apparatus sets an operation condition in accordance with the type specified by the user.

Unfortunately, users have difficulty in correctly specifying the type of a sheet since the types of sheets usable in an image forming apparatus have recently been diversified. For this reason, attention is paid to a method in which the image forming apparatus automatically detects the type of a sheet based on output from a predetermined sensor.

A configuration in which a so-called media sensor for detecting the type of the sheet is disposed on a conveyance path is known. According to the configuration, the type can be determined by detecting physical quantity such as translucency and thickness, which are difficult to be detected in the state where sheets are stacked on a sheet table. In addition, in an apparatus including a plurality of sheet tables, one media sensor can detect the type of a sheet regardless of from which sheet table the sheet is ejected.

When the media sensor is disposed on the conveyance path for the sheet, preparation (finishing) for image formation is performed in parallel to conveyance of the sheet to a sensor position in order to shorten first print output time (FPOT) during execution of a print job. The preparation for image formation in an electrophotographic image forming apparatus includes processing of, for example, rotating a photoconductor to be charged.

In the preparation for image formation, the operation condition corresponding to one of a plurality of types assumed for a sheet is determined as a provisional condition. For example, the rotation velocity of a photoconductor and charging bias are set as forming an image under the provisional condition. When the detected type of the sheet is different from the type corresponding to the provisional type, the provisional condition is switched to a fixed condition corresponding to the detected type detected. After image formation under the fixed condition is made possible, the image formation is started.

JP 2013-019946 A discloses a traditional art for reducing delay of the start of image formation in the case where an operation condition is switched after preparation for the image formation is started. In JP 2013-019946 A, the peripheral velocities of a photoconductor drum and an intermediate transfer belt are changed with toner interposed in a nip portion between the photoconductor drum and the intermediate transfer belt, in an image forming apparatus in which a drive source of the photoconductor drum is different from the drive source of the intermediate transfer belt.

According to the technique of JP 2013-019946 A, even when peripheral velocities of a photoconductor drum and an intermediate transfer belt are deviated from each other owing to different drive sources during switching from a provisional condition to a fixed condition, wear on the photoconductor drum and the intermediate transfer belt is reduced by interposing toner.

Toner of coloring material, however, is required to be kept attached to a photoconductor with a developing device turned on over a period in which rotations of the photoconductor drum and the intermediate transfer belt are stabled and the peripheral velocities thereof are equalized at least immediately before and after switching of the operation condition. Unfortunately, the coloring material is wastefully consumed.

SUMMARY

The invention has been made in consideration of such a problem, and an object of the invention is to reduce delay of the start of image formation in the case where an operation condition is switched after starting start-up without wastefully consuming coloring material.

To achieve the abovementioned object, according to an aspect of the present invention, there is provided an image forming apparatus that forms an image on a sheet medium under an operation condition set in accordance with a type of the medium, and the image forming apparatus reflecting one aspect of the present invention comprises a hardware processor that: detects which of a plurality of assumed types the type of the medium applies to, based on output from a sensor provided on a conveyance path for the medium; and performs control under which, before the type of the medium is detected, shift to a quasi-rise state, in which preparation for image formation under a provisional condition has partially been completed, is performed, the provisional condition corresponding to an operation condition corresponding to one of the plurality of assumed types, and after the type of the medium is detected, shift to a rise state, in which preparation for image formation under a fixed condition has been completed, is performed, the fixed condition corresponding to an operation condition corresponding to the detected type.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3 illustrates an example of an operation condition table;

FIG. 6 illustrates an example of a combination of a drive source of the main part and an object to be driven in tabular form;

FIG. 8 illustrates an example of a sheet determination table;

FIG. 9 illustrates the first example of improved start-up control;

FIG. 10 illustrates the second example of the improved start-up control;

FIGS. 25A and 25B illustrate examples of setting tables related to the start-up control;

FIGS. 26A to 26C illustrate examples of the setting tables related to the start-up control; and FIG. 27 illustrates an example of the setting tables related to the start-up control.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
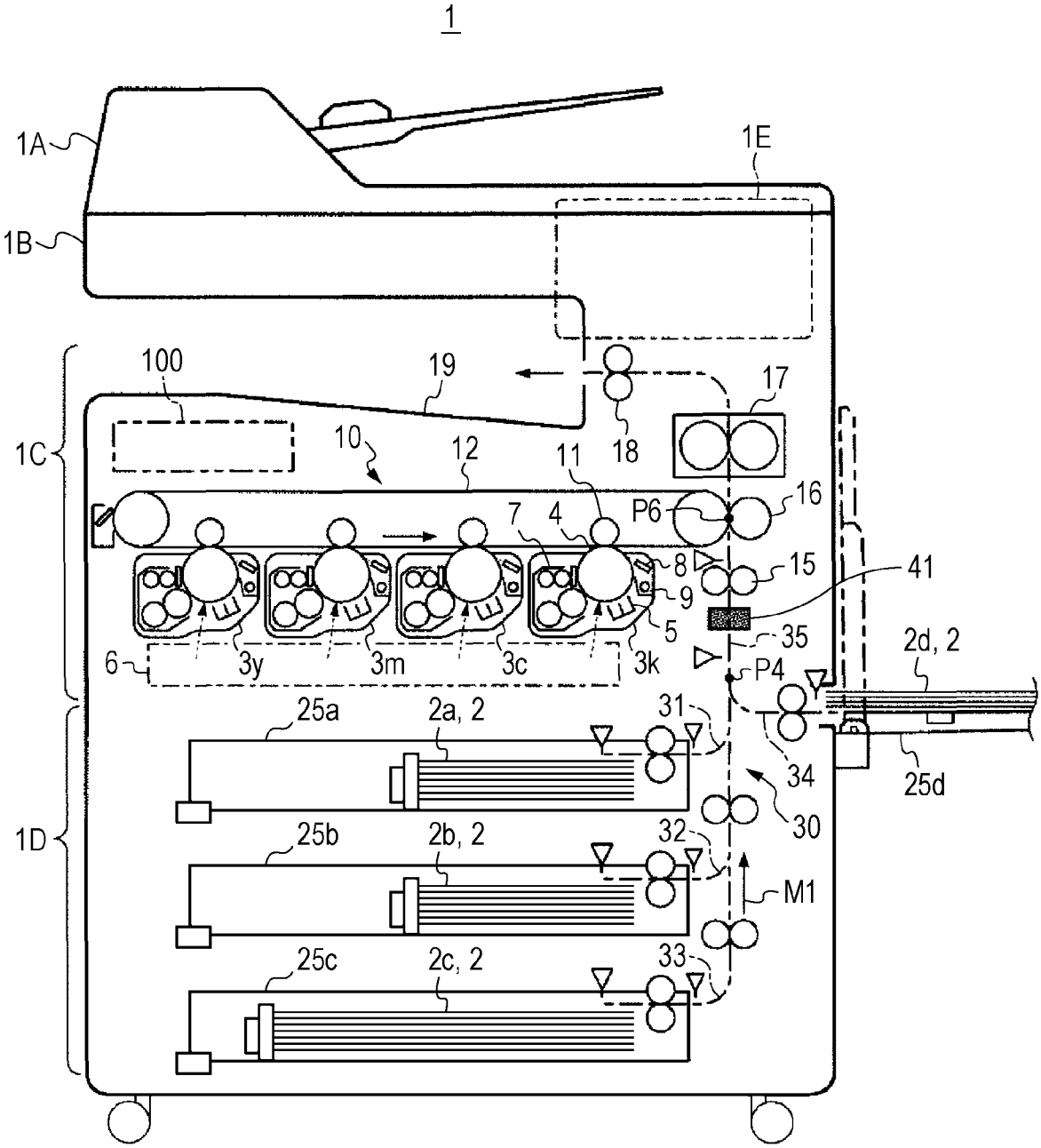
FIG. 1 illustrates an outline of the configuration of an image forming apparatus according to an embodiment of the invention.
Figure 2A:
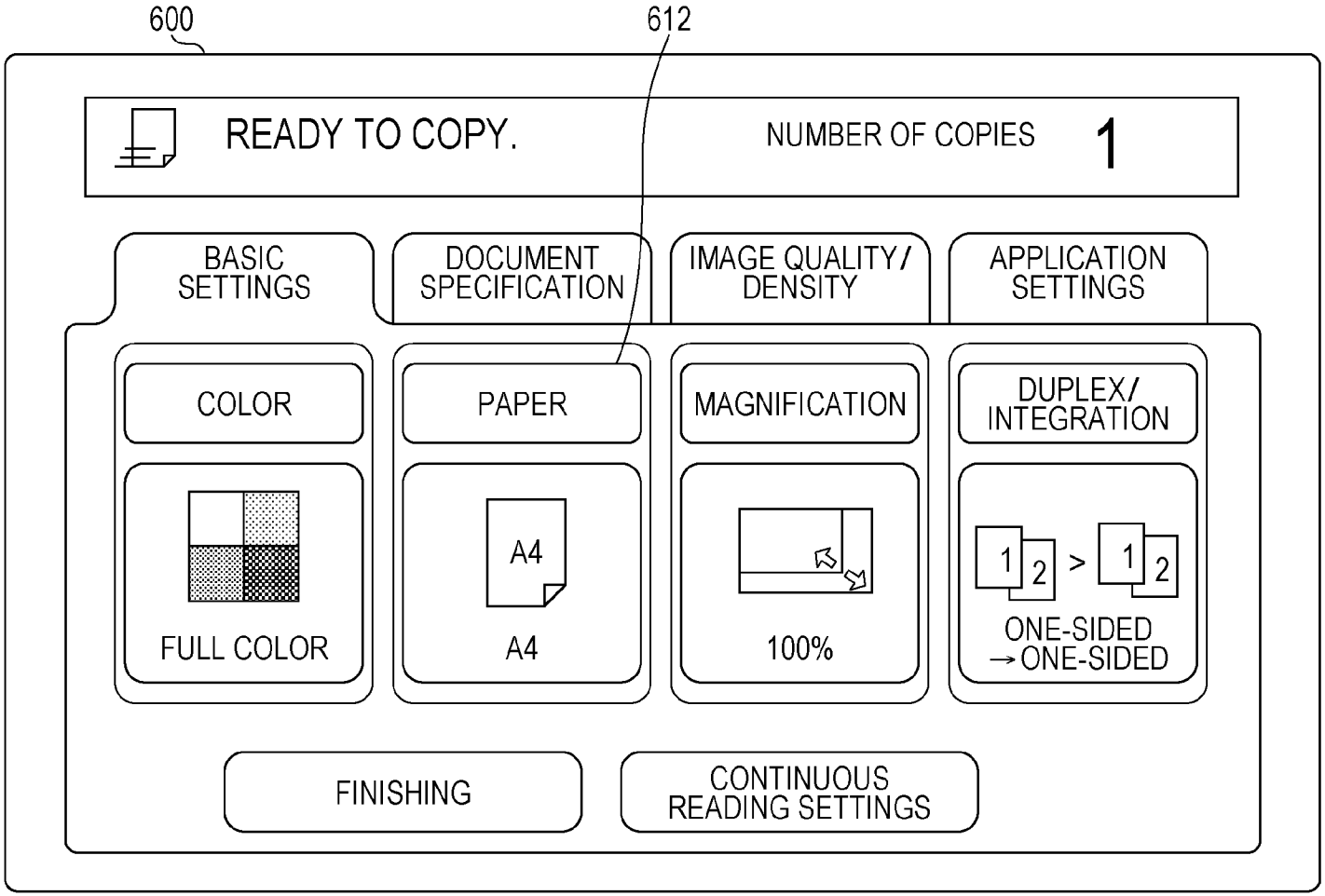
FIGS. 2A and 2B illustrate examples of operation screens related to detection of the type of a sheet.
Figure 2B:
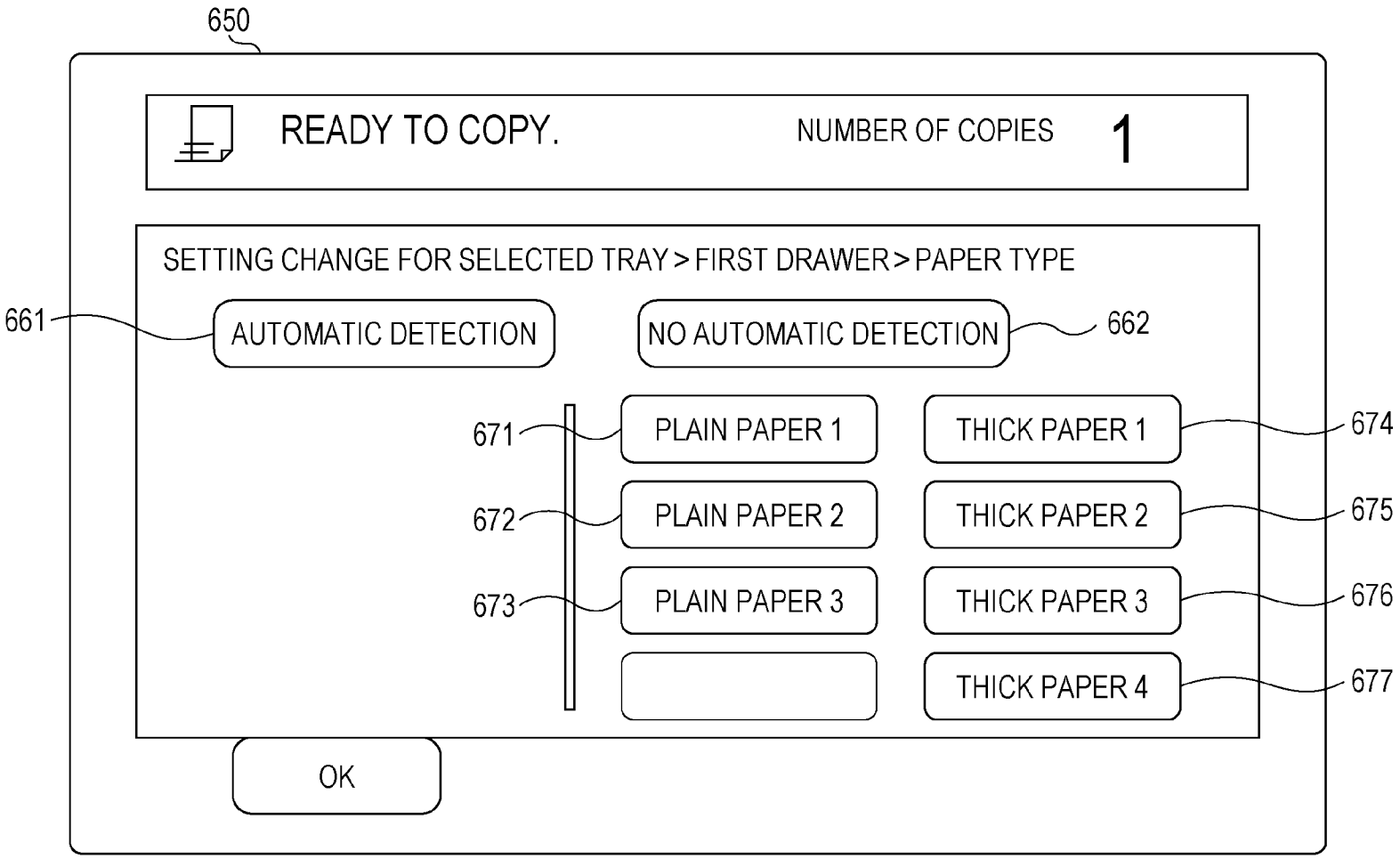

FIG. 1 illustrates an outline of the configuration of an image forming apparatus 1 according to an embodiment of the invention. FIGS. 2A and 2B illustrate examples of operation screens 600 and 650 related to detection of the type of a sheet 2. FIG. 3 illustrates an example of an operation condition table D10.

The image forming apparatus 1 in FIG. 1 is a multifunctional peripheral (M P: multifunctional machine or combined machine) in which functions such as a copier, a printer, a facsimile machine, and an image reader are integrated.

The image forming apparatus 1 includes an auto document feeder (ADF) 1A, a flatbed scanner 1B, an electrophotographic color printer 1C, a sheet cabinet 1D, and an operation panel 1E.

The sheet cabinet 1D is of type of drawer having a three-stage configuration with paper feeding trays 25*a*, 25*b*, and 25*c*. A manual feeding tray 25*d* is provided on a right-side part of the image forming apparatus 1. The operation panel 1E has a touch panel display for displaying a screen for operation from a user, and outputs a signal in response to input operation. In response to the signal, a control circuit 100 controls operations of the image forming apparatus 1.

The auto document feeder 1A conveys a document (sheet) set in a document tray to a reading position of the scanner 1B. The scanner 1B reads an image from a sheet document conveyed from the auto document feeder 1A or various documents set on platen glass to generate image data.

The color printer 1C forms a color or monochrome image on one side or both sides of a sheet (recording medium) 2 in a print job such as copying, network printing (PC printing), facsimile reception, and box printing. The color printer 1C includes an electrophotographic tandem printer engine 10. The printer engine 10 includes four imaging units 3*y*, 3*m*, 3*c*, and 3*k*, a print head 6, and an intermediate transfer belt 12.

Each of the imaging units 3*y* to 3*k* includes a cylindrical photoconductor (PC) 4, a charger 5, a developing device 7, an eraser 8, and a cleaner 9. The eraser 8 eliminates electricity of the photoconductor 4 by applying light. The cleaner 9 removes deposits such as residual toner from the photoconductor 4 by, for example, bringing a blade into contact. The imaging units 3*y* to 3*k* have basically the same configuration.

The print head 6 emits a laser beam for pattern exposure to each of the imaging units 3*y* to 3*k*. Main-scanning for deflecting the laser beam in a rotation-axis direction of the photoconductor 4 is performed in the print head 6. In parallel with the main scanning, sub-scanning for rotating the photoconductor 4 at a constant velocity is performed.

The intermediate transfer belt 12 is a transfer-receiving object in primary transfer of a toner image. The intermediate transfer belt 12 is wound around between a pair of rollers to be rotated. A primary transfer roller 11 is disposed inside the intermediate transfer belt 12 for each of the imaging units 3*y*, 3*m*, 3*c*, and 3*k*.

In a color printing mode, each of the imaging units 3*y* to 3*k* forms a toner image of each of four colors: yellow (Y), magenta (M), cyan (C), and black (K) in parallel. The toner images of each of the four colors are primarily transferred sequentially on the rotating intermediate transfer belt 12. First, the toner image of Y is transferred. The toner images of M, C, and K are sequentially transferred so as to be superimposed on the toner image of Y.

The primarily transferred toner image is secondarily transferred to the sheet 2 at a printing position P6. The sheet 2 is ejected and conveyed from one of the paper feeding trays 25*a* to 25*c* or the manual feeding tray 25*d* via a timing roller 15. The printing position P6 faces a secondary transfer roller 16. That is, for example, the toner image is electrostatically attracted by transfer voltage applied to the secondary transfer roller 16, and moved from the intermediate transfer belt 12 to the sheet 2. After the secondary transfer, the sheet 2 passes through the inside of a fuser 17 and is sent to a paper ejecting tray 19 by an ejection roller 18. When passing through the fuser 17, the toner image is fixed to the sheet 2 by heating and pressurization.

In a monochrome printing mode, a toner image is formed by the imaging unit 3*k*. The imaging unit 3*k* is closest to the printing position (secondary transfer position) P6 of the four imaging units 3*y* to 3*k*. That is, monochrome printing color is black (K). No toner image is formed by the other imaging units 3*y* to 3*c*. As in the color printing mode, the primary transfer, the secondary transfer, and the fixing are performed to form a monochrome image on the sheet 2.

The upper-stage paper feeding tray 25*a*, the middle-stage paper feeding tray 25*b*, and the lower-stage paper feeding tray 25*c* have basically the same configuration. A large number of sheets 2 (2*a*, 2*b*, and 2*c*) can be set in each of the paper feeding trays 25*a* to 25*c*. To set means to put the sheets 2 in a stack in the paper feeding tray.

A large number of sheets 2*d* can be set in a stack also in the manual feeding tray 25*d*. The sheet 2*d* may be a long sheet that does not fit in the paper feeding trays 25*a* to 25*c*.

It should be noted that, in the following description, the paper feeding trays 25*a* to 25*c* and the manual feeding tray 25*d* are sometimes referred to as a "tray 25" without distinction.

The sheet 2 passes through a conveyance path 30 inside the image forming apparatus 1. The conveyance path 30 includes paper feeding paths 31, 32, 33, and 34, and a common path 35. The paper feeding paths 31, 32, 33, and 34 correspond to each one of the four trays 25. Only the sheet 2 ejected from the tray 25 corresponding to each of the paper feeding paths 31 to 34 passes through each of the paper feeding paths 31 to 34. In contrast, all of the sheets 2*a*, 2*b*, 2*c*, and 2*d*, which are set in the different trays 25, pass through the common path 35. That is, the common path 35 is common for four trays 25. In the embodiment, the manual feeding tray 25*d* is disposed above the upper-stage paper feeding tray 25*a*. A path from a junction P4 to the ejection roller 18 thus corresponds to the common path 35. The junction P4 corresponds to an end of the paper feeding path 34.

The image forming apparatus 1 includes a media sensor (sheet attribute sensor) 41 for detecting the type of the sheet 2. The image forming apparatus 1 sets printing operation condition in accordance with the detected type based on output from the media sensor 41, so that a suitable image can be obtained.

The media sensor 41 is disposed at a position on the upstream side of the printing position P6 in the common path 35, more specifically, between the timing roller 15 and the junction P4.

A single media sensor 41 can detect the types of the sheets 2*a*, 2*b*, 2*c*, and 2*d* regardless of the number of trays 25 by being disposed on the common path 35. This configuration enables size and cost reductions resulted from reduction in the number of sensors.

In addition, placing the media sensor 41 on the upstream side of the timing roller 15 enables, when a printing operation condition is switched after detection of the type, switching time to be secured with the sheet 2 being placed on standby before the printing position P6 as necessary.

The media sensor 41 acquires information to be used for determining the type from the sheet 2. For example, the media sensor 41 is an optical sensor. The media sensor 41 applies detection light to the sheet 2 moving to the timing roller 15, and acquires a received amount of the detection light that is transmitted through the sheet 2 as information for determining the basis weight of the sheet 2. The media sensor 41 sends a detection signal indicating the received light amount to the control circuit 100.

When starting execution of an input print job, the image forming apparatus 1 selects one of the trays 25 in accordance with a specification of the job. For example, the image forming apparatus 1 selects the tray 25 in which the sheet 2 corresponding to an output image size specified by the job is set. Alternatively, when the tray 25 is specified by the job, the image forming apparatus 1 selects the specified tray 25.

When the previously detected type of the sheet 2 is stored in relation to the selected tray 25, the image forming apparatus 1 sets an operation condition in accordance with the stored type, ejects the sheet 2 from the selected tray 25, and performs printing under the set operation condition. In this case, the image forming apparatus 1 does not perform type detection based on an output from the media sensor 41.

In contrast, when the type of the sheet 2 is not stored in relation to the selected tray 25, the image forming apparatus 1 ejects the sheet 2 from the selected tray 25, conveys the sheet 2 to the timing roller 15. Meanwhile, the image forming apparatus 1 detects the type of the sheet 2 based on the output from the media sensor 41. The image forming apparatus 1 then sets an operation condition in accordance with the detected type to perform printing. It should be noted that, in the continuous print job, the image forming apparatus 1 performs the type detection for the first sheet 2, and does not perform the type detection for the second and subsequent sheets 2.

An "automatic mode" and a "manual mode" are provided in the image forming apparatus 1. In the automatic mode, the type of the sheet 2 is automatically detected as described above, and a printing operation condition is set. In the manual mode, an operation condition is set in response to the type manually input by a user. The user can specify the type by performing the following operations.

In a state of waiting for a user operation, an initial screen 600 illustrated in FIG. 2A is displayed on the operation panel 1E. The user touches a paper button 612 of the initial screen 600, and specifies a desired tray 25 on a tray specifying screen (not illustrated) displayed by the touch. When the user specifies the tray 25, a type specifying screen 650 illustrated in FIG. 2B is displayed.

An automatic mode selecting button 661, a manual mode selecting button 662, and type selecting buttons 671 to 677 are disposed on the type specifying screen 650. The type selecting buttons 671 to 677 correspond to seven types of plain paper 1, plain paper 2, plain paper 3, thick paper 1, thick paper 2, thick paper 3, and thick paper 4, which are classified by basis weight.

When the user wants to specify a type, the user specifies the manual mode by touching the manual mode selecting button 662, and then specifies the type by touching one of the type selecting buttons 671 to 677. When the automatic mode selecting button 661 is touched in the state where the manual mode is set, the mode is switched to the automatic mode. Such kind of manual input can be individually performed for each of the four trays 25 including the manual feeding tray 25*d*.

When the manual mode is set for the tray 25 selected at the job execution, the image forming apparatus 1 does not perform the type detection. The operation condition in this case is made to correspond to the type specified by the user.

The operation condition is a combination of a plurality of operation condition values Dc (Dc1 to Dc4) illustrated in the operation condition table D10 in FIG. 3. In the example of FIG. 3, a process velocity (image formation velocity) Vs, a fixing temperature (fixing set temperature) Ts, a secondary transfer output V16, and a fog margin Vm are associated with each of seven types Dk as operation condition values Dc.

The process velocity Vs is a condition specifying the conveyance velocity of the sheet 2 in secondary transfer and fixing, the peripheral velocity of the photoconductor 4, and the moving velocity of the intermediate transfer belt 12. In the example of FIG. 3, the pieces of plain paper 1 to 3 have a process velocity Vs of 290 mm/s, which is the fastest. The pieces of thick paper 1 and 2 have a process velocity Vs of 210 mm/s, which is the second fastest. The pieces of thick paper 3 and 4 have a process velocity Vs of 105 mm/s, which is the slowest.

The fixing temperature Ts is a heating temperature with a fixing heater 217 in the fuser 17. The secondary transfer output V16 is the output voltage of a high-voltage power supply circuit that biases the secondary transfer roller 16.

The fog margin Vm is a condition for preventing fogging, which is a phenomenon of toner depositing on a base part, and corresponds to the difference between the charging potential of the photoconductor 4 and development DC output. When the development DC output is fixed, the fog margin Vm is a condition specifying the charging potential. The fog margin Vm is adjusted by controlling the output voltage (charging DC output), which substantially determines the charging potential, of the high-voltage power supply circuit.

When detection of the type Dk of the sheet 2 is performed, preparation for image formation, that is, start-up of an electrophotographic process is performed in parallel with conveyance of the sheet 2 to a sensor position where the media sensor 41 is disposed.

In this start-up, the operation condition corresponding to one of a plurality of assumed types Dk is defined as a "provisional condition". For example, the rotation velocity of the photoconductor 4 and the charging potential are controlled assuming that an image is formed under the provisional condition.

In the embodiment, the provisional condition can be varied. A predefined "initially set condition" is sometimes defined as the provisional condition. An "optionally set condition" is sometimes determined as the provisional condition. The optionally set condition is selected from all operation conditions including the initially set condition with reference to the later-described setting table.

It should be noted that, in the following description, the type corresponding to the initially set condition is sometimes described as an "initially set type". The type corresponding to the optionally set condition is sometimes described as "optionally set type. The initially set type and the optionally set type are sometimes collectively referred to as a "provisional type".

The type Dk is detected after the start-up under the provisional condition is started. The operation condition suitable for image formation is fixed by the detection. When a fixed type Dkd, which is the detected type Dk, is the same as a provisional type Dkp, that is, when a "fixed condition" corresponding to the fixed type Dkd matches the provisional condition, the start-up under the provisional condition continues. After the image formation under the provisional condition (which is also the fixed condition in this case) is made possible, the image formation (latent image formation) is started.

In contrast, when the detected type Dk (fixed type Dkd) is different from the provisional type Dkp, the provisional condition is switched to the fixed condition. After image formation under the fixed condition is made possible, the image formation is started.

For example, the thick paper 3 among the seven types Dk in the operation condition table D10 in FIG. 3 is defined as the default provisional type Dkp, that is the initially set type. The thick paper 3 has the corresponding process velocity Vs that is one in the slowest-type group. That is, the initially set condition is the operation condition with the slowest process velocity Vs.

Slowing the process velocity Vs at the time of detecting the type Dk causes the time during which the sheet 2 passes through a detectable range of the media sensor 41 to be longer. This leads to increase in the number of detection performed in a control cycle and higher accuracy. In addition, this configuration can prevent a jam, which tends to happen when the sheet 2 is conveyed fast. The sheet 2 is preferably conveyed slowly in terms of the structure of the conveyance path 30 and deterioration with time of a conveyance roller.

It is noted, however, that, when the conveyance performance is high and risk of the jam is small, a type other than the type having the slowest process velocity Vs may be defined as the initially set type.

In addition, for example, when the type Dk of the sheet 2 routinely used by the user is almost determined, the type Dk may be defined as the provisional type Dkp. In that case, the type Dk of the sheet 2 most commonly used by the user can be defined as the provisional type Dkp, for example, in accordance with user specification, or based on a past use record.

The image forming apparatus 1 includes a function for implementing start-up in accordance with the configuration of a main part related to image formation. The function is provided for causing time required from detection of the type Dk to the start of the image formation to be shorter than ever before when the provisional type Dkp and the fixed type Dkd is different.

The configuration and operation of the image forming apparatus 1 will be described below focusing on this function.

Each of FIGS. 4A to 4D and 5 illustrates an example of the configuration of a drive unit in the main part related to image formation. In addition, FIG. 6 illustrates an example of a combination of a drive source for the main part and an object to be driven in tabular form.

Five configurations [1] to [5] illustrated in FIGS. 4A to 4D, 5 and 6 are alternatively adopted for the image forming apparatus 1.

In any of the configurations [1] to [5], the photoconductors 4 of the imaging units 3*y*, 3*m* and 3*c* are rotationally driven by a common drive source. These three photoconductors 4 will hereinafter collectively referred to as a "color photoconductor 4*ymc*" or a "photoconductor 4*ymc*".

In addition, in any of the configurations [1] to [5], the photoconductors 4 of the imaging unit 3*k* is rotationally driven by a drive source different from the drive source for the color photoconductor 4*ymc*. The photoconductor 4 of the imaging unit 3*k* will hereinafter be referred to as a "monochrome photoconductor 4*k*" or a "photoconductor 4*k*".

Details of each of the configurations [1] to [5] are as follows.

Figure 4A:
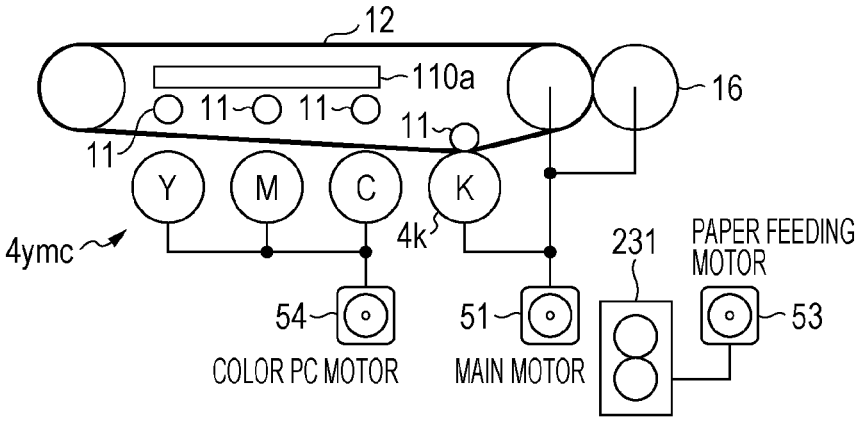
FIGS. 4A to 4D illustrate examples of the configuration of a drive unit in a main part related to image formation.

In the configuration [1], as illustrated in FIG. 4A, a main motor 51 drives the monochrome photoconductor 4*k*, the intermediate transfer belt 12, and the secondary transfer roller 16. A color PC motor 54 drives the color photoconductor 4*ymc*. A paper feeding motor 53 drives a paper feeding conveyor 231. The paper feeding conveyor 231 is a part that conveys the sheet 2 from the tray 25 to the timing roller 15 among mechanisms conveying the sheet 2. That is, the paper feeding conveyor 231 is related to the type detection.

In the configuration [1], a pressure-contact/separation mechanism 110*a* is provided. The pressure-contact/separation mechanism 110*a* brings the color photoconductor 4*ymc* and the intermediate transfer belt 12 into pressure contact with each other and separates the color photoconductor 4*ymc* and the intermediate transfer belt 12 from each other by collectively moving the three primary transfer roller 11 corresponding to the color photoconductor 4*ymc*.

The primary transfer roller 11 corresponding to the monochrome photoconductor 4*k* is fixedly disposed so that the monochrome photoconductor 4*k* and the intermediate transfer belt 12 are constantly in pressure contact with each other. This configuration can simplify the structure, thereby reducing the manufacturing cost. It is noted, however, that a mechanism enabling pressure-contact/separation between the monochrome photoconductor 4*k* and the intermediate transfer belt 12 may be provided.

The state of pressure-contact/separation between the photoconductor 4*ymc* and 4*k* and the intermediate transfer belt 12 in the configuration [1] includes two ways of "K pressure contact" and "full pressure contact". The K pressure contact means pressure contact of only the photoconductor 4*k*. The full pressure contact means pressure contact of all of the photoconductors 4*ymc* and 4*k*. FIG. 4A illustrates the state of the K pressure contact.

Figure 4B:
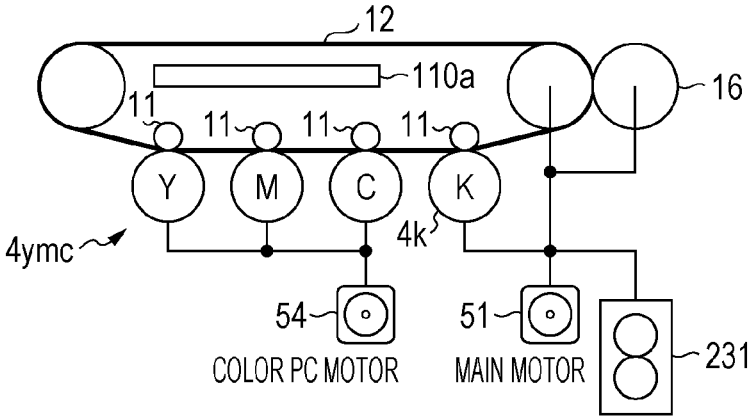

The configuration [2] illustrated in FIG. 4B is obtained by changing a part of the above-described configuration [1]. The change is that the drive source for the paper feeding conveyor 231 is changed from the paper feeding motor 53 to the main motor 51. FIG. 4B illustrates the state of the full pressure contact.

Figure 4C:
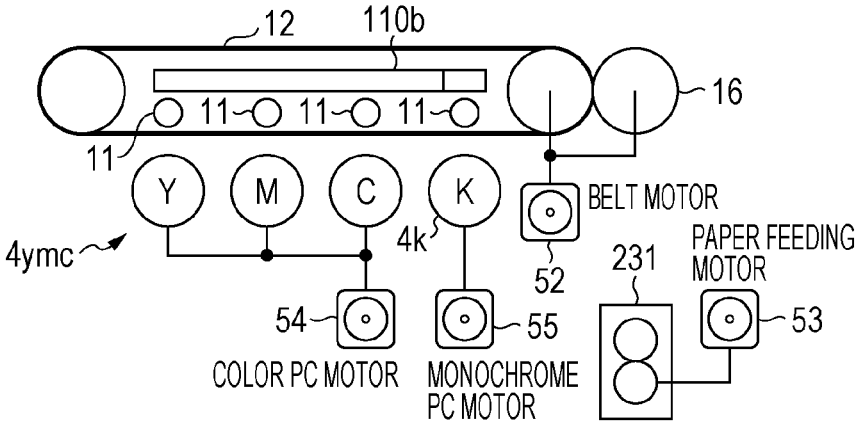

In the configuration [3] illustrated in FIG. 4C, a monochrome PC motor 55, which is a single drive source, drives the monochrome photoconductor 4*k*. The color PC motor 54 drives the color photoconductor 4*ymc*. A belt motor 52 drives the intermediate transfer belt 12 and the secondary transfer roller 16. The paper feeding motor 53 drives the paper feeding conveyor 231.

In the configuration [3], a pressure-contact/separation mechanism 110*b* is provided. The pressure-contact/separation mechanism 110*b* brings the color photoconductor 4*ymc* and the intermediate transfer belt 12 into pressure contact with each other and separates the color photoconductor 4*ymc* and the intermediate transfer belt 12 from each other. The pressure-contact/separation mechanism 110*b* brings the monochrome photoconductor 4*k* and the intermediate transfer belt 12 into pressure contact with each other and separates the monochrome photoconductor 4*k* and the intermediate transfer belt 12 from each other, independently from the color photoconductor 4*ymc*.

The state of pressure-contact/separation between the photoconductor 4*ymc* and 4*k* and the intermediate transfer belt 12 in the configuration [3] includes three ways of "full separation", "K pressure contact", and "full pressure contact". The full separation means separation of all of the photoconductors 4*ymc* and 4*k*. FIG. 4C illustrates the state of the full separation.

Figure 4D:
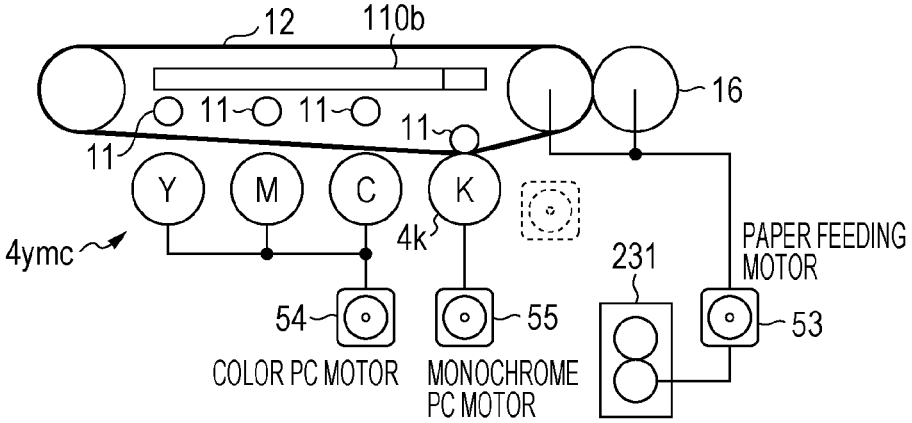

The configuration [4] illustrated in FIG. 4D is obtained by changing a part of the configuration [3]. The change is that the drive source for the intermediate transfer belt 12 and the secondary transfer roller 16 is changed from the belt motor 52 to the paper feeding motor 53. FIG. 4D illustrates the state of the K pressure contact.

Figure 5:
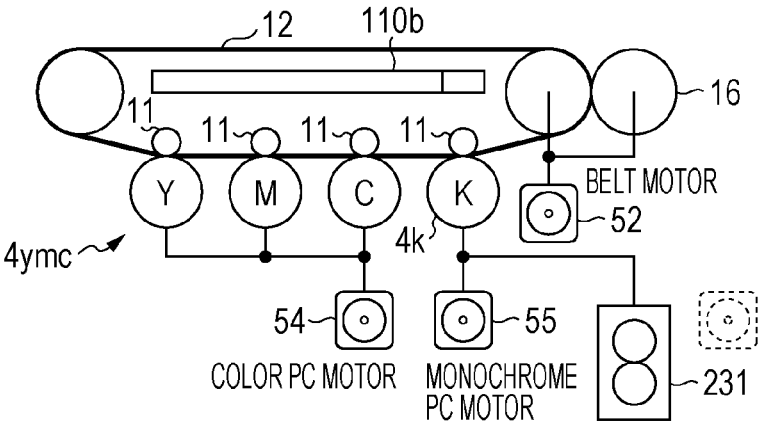
FIG. 5 illustrates an example of the configuration of the drive unit in the main part related to image formation.

The configuration [5] illustrated in FIG. 5 is obtained by changing a part of the configuration [3]. The change is that the drive source for the paper feeding conveyor 231 is changed from the paper feeding motor 53 to the monochrome PC motor 55. FIG. 5 illustrates the state of the full pressure contact.

It should be noted that, when a common drive source drives the photoconductor 4*k* and the paper feeding conveyor 231 as in the configurations [2] and [5], paper feeding can be started at timing delayed from the start of rotation of the photoconductor 4*k* by, for example, interposing a clutch between the drive source and the paper feeding conveyor 231.

Figure 7:
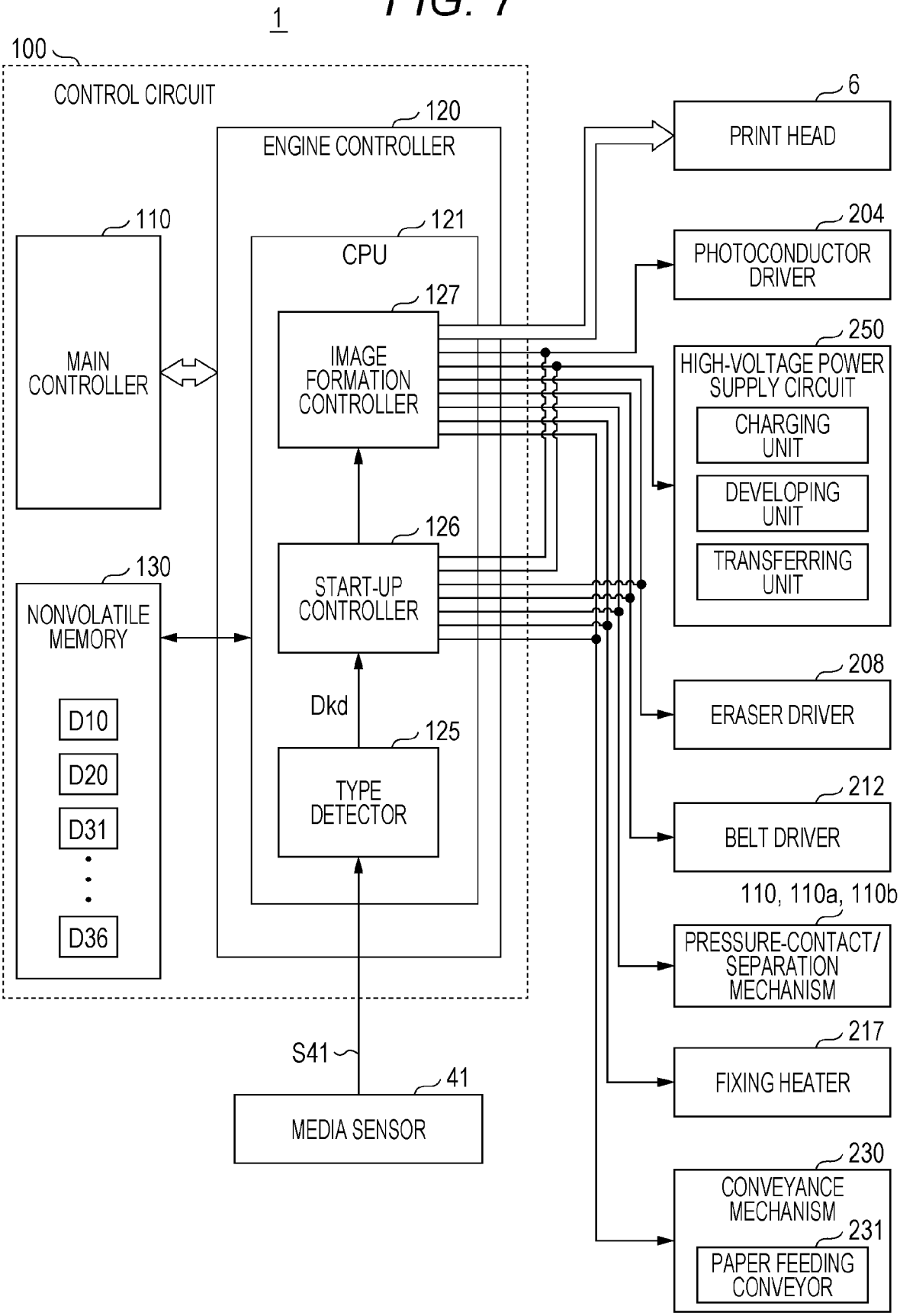
FIG. 7 illustrates the configuration of a control circuit.

FIG. 7 illustrates the configuration of the control circuit 100, and FIG. 8 illustrates an example of a sheet determination table D20.

The control circuit 100 includes a main controller 110, an engine controller 120, and a nonvolatile memory 130. The main controller 110 controls the entire image forming apparatus 1. The engine controller 120 mainly controls the printer engine 10. Various pieces of control data are stored in the nonvolatile memory.

When a print job is input by an operation with the operation panel 1E or communication with an external host device, the main controller 110 selects the tray 25 to be used for printing.

When the type Dk is stored for the selected tray 25, the main controller 110 notifies the engine controller 120 of the stored type Dk, and commands the engine controller 120 to perform predetermined control in accordance with the print job.

In contrast, when the type Dk is not stored for the selected tray 25, the main controller 110 commands the engine controller 120 to detect the type Dk and execute the print job.

The engine controller 120 includes a central processing unit (CPU) 121 and peripheral devices (e.g., ROM and RAM). The CPU 121 executes a control program. The engine controller 120 has functions of such as a type detector 125, a start-up controller 126, and an image formation controller 127. These functions are implemented by the hardware configuration of the control circuit 100 and by the control program being executed by the CPU.

The type detector 125 detects the type Dk of the sheet 2 that is ejected from the tray 25 and conveyed to the sensor position based on a detection signal S41 output from the media sensor 41. Specifically, when receiving a detection command from the main controller 110, the type detector 125 fetches the detection signal S41 at predetermined appropriate timing. The type detector 125 acquires the type Dk corresponding to a value of the detection signal S41 as a detection result from the sheet determination table D20. In the sheet determination table D20, the value of the detection signal S41 (value converted into the basis weight in FIG. 8) and the type Dk correspond to each other as illustrated in FIG. 8. That is, the type detector 125 detects which of a plurality of types Dk illustrated in the sheet determination table D20 the type Dk of the sheet 2 corresponds to. The type detector 125 notifies the start-up controller 126 of the type Dk detected in such a way as the fixed type Dkd.

The start-up controller 126 performs start-up control for shifting the printer engine 10 to a rise state where image formation in the color printing mode or the monochrome printing mode is possible. In the rise state, pattern exposure (latent image formation) based on print data with the print head 6 may be started. A non-rise state, at which the start-up control is started, includes a state, for example, where the fuser 17 has completed a warm-up but the photoconductor 4 is not charged.

The start-up controller 126 controls a photoconductor driver 204, a high-voltage power supply circuit 250, an eraser driver 208, a belt driver 212, a pressure-contact/separation mechanism 110, the fixing heater 217, and a conveyance mechanism 230.

The photoconductor driver 204 has a motor for driving the photoconductors 4*k* and 4*ymc*. The high-voltage power supply circuit 250 outputs voltage for charging, development, and primary transfer in the imaging units 3*y* to 3*k* and voltage for secondary transfer with the secondary transfer roller 16.

The eraser driver 208 is a power supply circuit for causing a light source of the eraser 8 in the imaging units 3*y* to 3*k* to emit light.

The belt driver 212 includes a motor for driving the intermediate transfer belt 12. The pressure-contact/separation mechanism 110 corresponds to the above-described pressure-contact/separation mechanism 110*a* or 110*b*. The fixing heater 217 is a heat source of the fuser 17.

The conveyance mechanism 230 includes a drive source, which is related to conveyance of the sheet 2 from the tray 25 to the paper ejecting tray 19, a clutch, and a paper feeding conveyor 231.

The configuration of each of the photoconductor driver 204, the belt driver 212, the pressure-contact/separation mechanism 110, and the conveyance mechanism 230 among these objects to be controlled is changed depending on which one of the above-described configurations [1] to [5] is adopted. For example, when the configuration [1] or [2] is adopted, the photoconductor driver 204 includes the belt driver 212. When the configuration [4] is adopted, the paper feeding conveyor 231 doubles as the belt driver 212.

The start-up controller 126 notifies the image formation controller 127 that the shift to the rise state is completed. When receiving the notification, the image formation controller 127 controls an object to be controlled instead of the start-up controller 126, and transfers the print data to the print head 6 to cause the print head 6 to perform pattern exposure (printing). That is, the image formation controller 127 controls the printer engine 10 so that the number of pieces of paper specified by the print job is printed.

The start-up controller 126 performs "improved start-up control" as necessary. The improved start-up control is start-up control under which, when the type Dk of the sheet 2 is detected, no shift to the rise state is performed until detection is finished. Whether the improved start-up control is necessary is determined depending on which configuration of the configurations [1] to [5] is adopted.

Specifically, in the improved start-up control, shift to a "quasi-rise state" is performed before the type Dk is detected, and shift to the rise state is performed after the type Dk is detected. In the quasi-rise state, preparation for image formation under the provisional condition has been partially completed. In the rise state, the preparation for image formation under the fixed condition has been completed.

More specifically, the improved start-up control includes first and second aspects whose quasi-rise states are different from each other.

In the quasi-rise state in the first aspect, "the photoconductor 4 having a drive source different from that of the intermediate transfer belt 12 is separated from the intermediate transfer belt 12, and the photoconductor 4 having a drive source different from that of the paper feeding conveyor 231 is stopped".

In the quasi-rise state in the second aspect, "the photoconductor 4 having a drive source different from that of the intermediate transfer belt 12 is separated from the intermediate transfer belt 12, and the photoconductor 4 having a drive source different from that of the paper feeding conveyor 231 is rotating at an optionally set velocity.

The optionally set velocity corresponds to the above-described optionally set condition.

An example of the improved start-up control will now be described assuming that color printing is performed by using the four photoconductors 4 (4*k* and 4*ymc*).

FIG. 9 illustrates the first example of the improved start-up control. FIG. 10 illustrates the second example of the improved start-up control.

[First Example of Improved Start-Up Control]

The first example of FIG. 9 includes control for shift to the quasi-rise state in the first aspect. Details are described as follows.

The content of the control varies depending on whether each of the color photoconductor 4*ymc* and the monochrome photoconductor 4*k* has the same (common) drive source as that of the intermediate transfer belt 12 and as that of the paper feeding conveyor 231.

Also referring to FIG. 6, the monochrome photoconductors 4*k* in the configurations [1] and [2] apply to a relation α in which the same drive source as that of the intermediate transfer belt 12 is used.

The monochrome photoconductor 4*k* in the configuration [2] applies to a relation α1 in which the relation α holds and the same drive source as that of the paper feeding conveyor 231 is used.

In addition, the monochrome photoconductor 4*k* in the configuration [1] applies to a relation α2 in which the relation α holds and a drive source different from that of the paper feeding conveyor 231 is used.

The monochrome photoconductors 4*k* in the configurations [3] to [5] and the color photoconductors 4*ymc* in the configurations [1] to [5] apply to a relation β in which a drive source different from that of the intermediate transfer belt 12 is used.

The monochrome photoconductor 4*k* in the configuration [5] applies to a relation β1 in which the relation β holds and the same drive source as that of the paper feeding conveyor 231 is used.

In addition, the monochrome photoconductors 4*k* in the configurations [3] and [4] and the color photoconductors 4*ymc* in the configurations [1] to [5] apply to a relation β2 in which the relation β holds and a drive source different from that of the paper feeding conveyor 231 is used.

[Case where Relation α Holds: Case where Relation α1 or α2 Holds]

In the case where the relation α holds, the peripheral velocities of the photoconductor 4 and the intermediate transfer belt 12 are rarely deviated from each other by switching the process velocity Vs. Thus, in the case, the photoconductor 4 and the intermediate transfer belt 12 are brought into pressure contact with each other before the type Dk is detected.

[Case Where Relation α1 Holds]

In the case where the relation α1 holds, the paper feeding conveyor 231 is driven for conveying the sheet 2 to the sensor position. The photoconductor 4 thus needs to be rotated before the type Dk is detected and the operation condition is fixed ("before condition fixing"). The rotation velocity of the photoconductor 4 before condition fixing corresponds to a velocity under the provisional condition, for example, a velocity (lowest velocity) under an initially set condition.

After the operation condition is fixed ("after condition fixing"), condition switching processing or restart-up processing is performed as processing for shift to the rise state under the fixed condition. In the condition switching processing, the operation condition is switched from the provisional condition to the fixed condition. In the restart-up processing, start-down for once returning to a non-start-up state is performed, and then start-up under the fixed condition is performed.

In the condition switching processing, at least one of the plurality of operation condition values Dc1 to Dc4 is changed in accordance with the fixed condition. The rotation velocity of the photoconductor 4 may be varied, or is not changed in some cases. For example, when the provisional condition corresponds to the initially set condition and the fixed condition corresponds to the operation condition corresponding to the plain paper 1 (see FIG. 3), the process velocity Vs is varied, so that the rotation velocity of the photoconductor 4 is varied. When the fixed condition corresponds to the operation condition corresponding to the thick paper 4, the process velocity Vs is not varied, so that the rotation velocity of the photoconductor 4 is not be varied.

The restart-up processing is performed instead of the condition switching processing in the case where response delay at switching of charging in the condition switching processing may cause fog. For example, when the difference of the fog margin Vm between under the provisional condition and under the fixed condition is equal to or greater than a threshold value, the restart-up processing is performed.

Both when the condition switching processing is performed and when the restart-up processing is performed, the photoconductor 4 and the intermediate transfer belt 12, which have been brought into pressure contact with each other before condition fixing, are not separated but kept in pressure contact with each other after condition fixing.

[Case Where Relation α2 Holds]

In the case where the relation α2 holds, the photoconductor 4 has a drive source independent of that of the paper feeding conveyor 231, so that the photoconductor 4 does not need to be rotated during conveyance of the sheet 2 to the sensor position. The photoconductor 4 is thus not rotated but kept stopped before condition fixing. Inevitably, charging is not performed. This, however, does not mean that no start-up control is performed.

Control to raise the temperature of at least the fuser 17 to the fixing temperature Ts under the provisional condition is performed. Consequently, a state of an electrophotographic process before condition fixing in the case where the relation α2 holds corresponds to the quasi-rise state, which is neither the non-rise state nor the rise state under the provisional condition, as described above.

After condition fixing, the start-up processing for shifting the photoconductor 4 and other objects to be controlled substantially in the non-rise state to the rise state under the fixed condition is performed.

[Case where Relation β Holds: Case where Relation β1 or β2 Holds]

In the case where the relation β holds, the peripheral velocities of the photoconductor 4 and the intermediate transfer belt 12 may be deviated from each other during switching of the process velocity Vs. Thus, in the case, the photoconductor 4 and the intermediate transfer belt 12 are kept separated from each other before condition fixing.

Even when the peripheral velocities deviate, the photoconductor 4 and the intermediate transfer belt 12 are not rubbed against each other, so that wear on these parts can be prevented. In addition, if the pressure contact is performed, the pressure contact needs to be again performed after separation before the subsequent switching of the process velocity Vs is once performed. The separation before condition fixing eliminates the need for the separation after condition fixing, thereby accelerating the start of the image formation by that time.

[Case where Relation β1 Holds]

In the case where the relation β1 holds, as in the case where the relation α1 holds, the photoconductor 4 is rotated before condition fixing. The rotation velocity corresponds to the velocity under the provisional condition, for example, the velocity under the initially set condition. Charging is then performed under the provisional condition.

In contrast to the case where the relation α1 holds, however, the photoconductor 4 and the intermediate transfer belt 12 are kept separated from each other, and thus the rise state under the provisional condition is not established. That is, before condition fixing, the electrophotographic process is put into the quasi-rise state.

The control after condition fixing is the same as in the case where the relation α1 holds. That is, the photoconductor 4 and the intermediate transfer belt 12 are kept in pressure contact with each other, and the condition switching processing or the restart-up processing is performed.

[Case where Relation β2 Holds]

In the case where the relation β2 holds, as in the case where the relation α2 holds, the photoconductor 4 is not rotated but kept stopped before condition fixing. The photoconductor 4 is not charged, but the control to raise the temperature of at least the fuser 17 to the fixing temperature Ts under the provisional condition is performed, so that the final state of the electrophotographic process before condition fixing corresponds to the quasi-rise state.

After condition fixing, the photoconductor 4 and the intermediate transfer belt 12 are brought into pressure contact with each other. In addition, as in the case where the relation α2 holds, the start-up processing for shifting the photoconductor 4 and other objects to be controlled to the rise state under the fixed condition is performed.

[Second Example of Improved Start-Up Control]

The second example in FIG. 10 includes control for shift to the quasi-rise state in the second aspect. Details are described as follows.

As in the first example, the content of control varies depending on which of the relations α, α1, α2, β, β1, and β2 holds.

[Case where Relation α1 Holds]

In the case where the relation α1 holds, the same control as that in the first example is performed. That is, before condition fixing, the photoconductor 4 and the intermediate transfer belt 12 are brought into pressure contact with each other, and the photoconductor 4 is rotated at, for example, a velocity under the initially set condition. After condition fixing, the condition switching processing or the restart-up processing is then performed.

[Case where Relation α2 Holds]

In the case where the relation α2 holds, before condition fixing, the photoconductor 4 and the intermediate transfer belt 12 are brought into pressure contact with each other, and the photoconductor 4 is rotated at a velocity under the optionally set condition. The photoconductor 4 is also charged under the optionally set condition. That is, the electrophotographic process is shifted to the rise state under the provisional condition before condition fixing.

In contrast to the first example in FIG. 9, when the fixed condition matches the provisional condition, the photoconductor 4 does not need to be shifted from a stopped state to a start-up state. This accelerates the start of image formation compared to the first example.

Since the improved start-up control is assumed to be performed when the fixed condition does not match the provisional condition, however, FIG. 10 illustrates a control content in the case where the fixed condition does not match the provisional condition.

That is, after condition fixing, as in the case where the relation α1 holds, the condition switching processing or the restart-up processing is performed.

[Case where Relation β1 Holds]

In the case where the relation β1 holds, the same control as that in the first example is performed. That is, before condition fixing, the photoconductor 4 and the intermediate transfer belt 12 are kept separated from each other, and the photoconductor 4 is rotated at, for example, a velocity under the initially set condition. The separation means that the state of the electrophotographic process before condition fixing corresponds to the quasi-rise state. After condition fixing, the photoconductor 4 and the intermediate transfer belt 12 are brought into pressure contact with each other, and the condition switching processing or the restart-up processing is performed.

[Case where Relation β2 Holds]

In the case where the relation β2 holds, before condition fixing, the photoconductor 4 and the intermediate transfer belt 12 are kept separated from each other, and the photoconductor 4 is rotated at a velocity under the optionally set condition. Also in this case, the state of the electrophotographic process before condition fixing corresponds to the quasi-rise state. After condition fixing, the photoconductor 4 and the intermediate transfer belt 12 are brought into pressure contact with each other, and the condition switching processing or the restart-up processing is performed.

A plurality of examples of timing of the start-up control in the case where the provisional type Dkp and the fixed type Dkd do not match each other will now be described. In any example, the provisional type Dkp corresponds to the initially set type (thick paper 3), and the fixed type Dkd corresponds to plain paper (1, 2, or 3). That is, a state where the sheet 2 is conveyed at a minimum velocity to detect the type Dk and then the velocity is switched to a maximum velocity is assumed.

Figure 11:
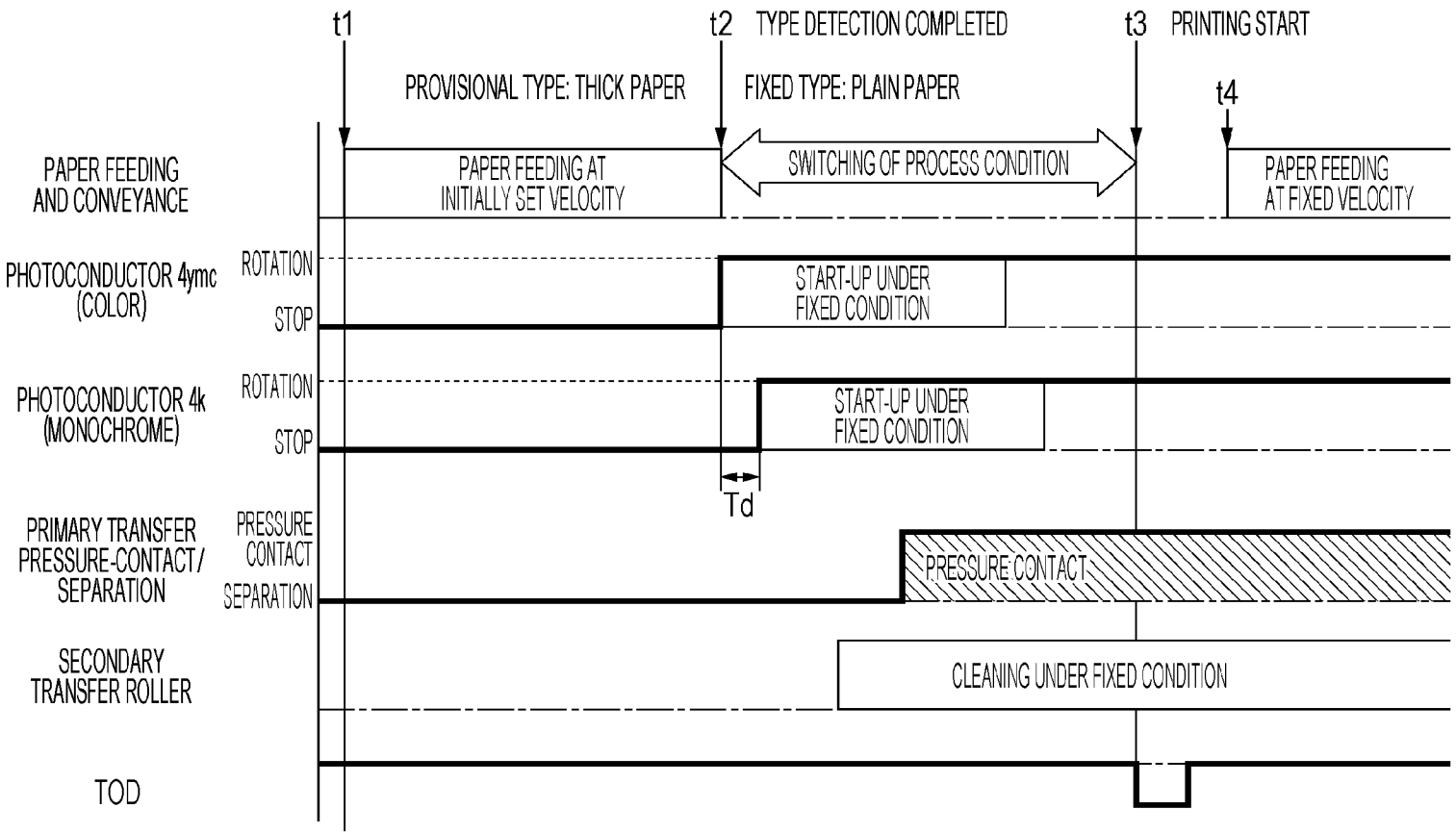
FIG. 11 illustrates the first example of timing of start-up control.
Figure 12:
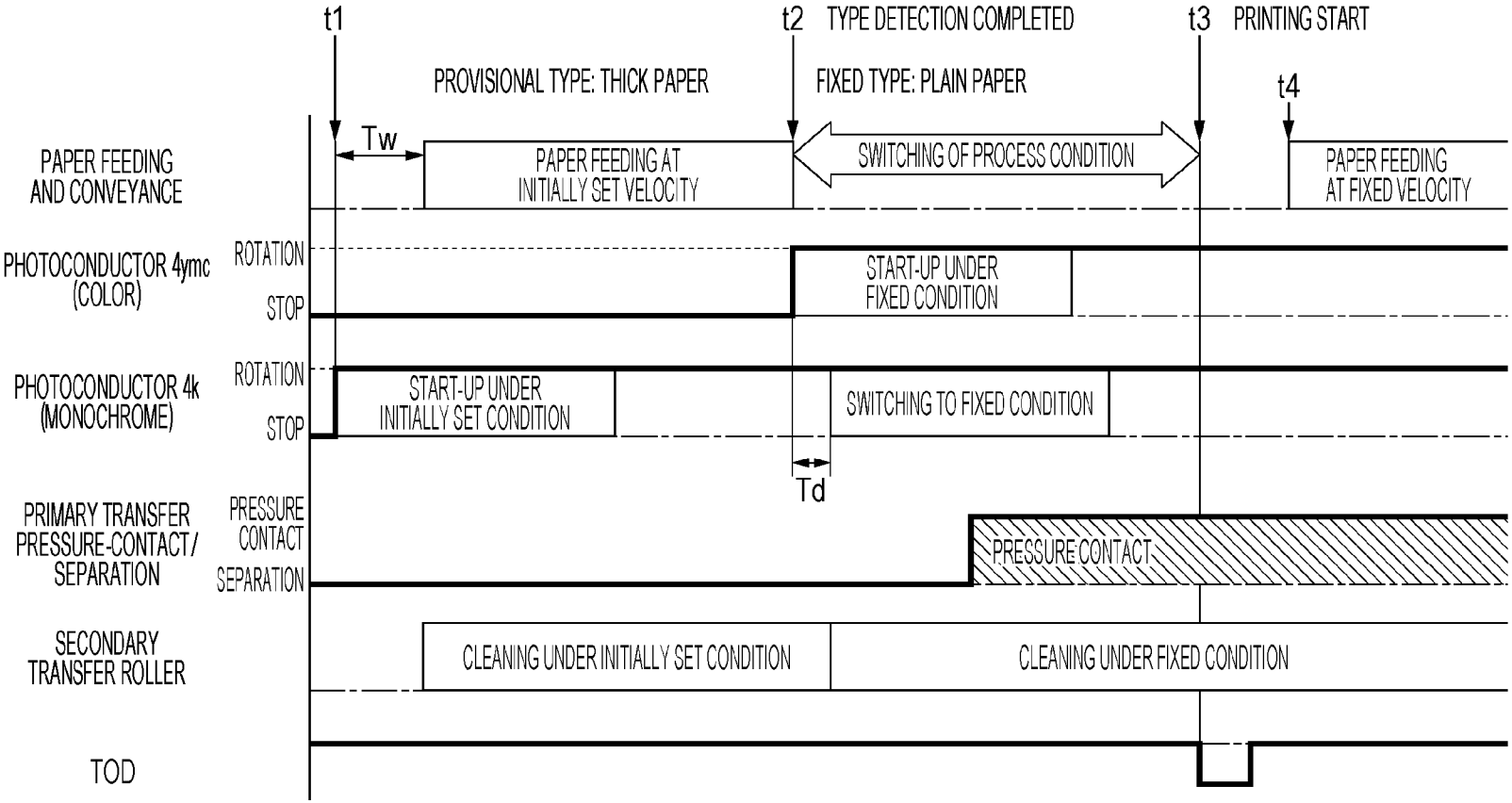
FIG. 12 illustrates the second example of the timing of the start-up control.
Figure 13:
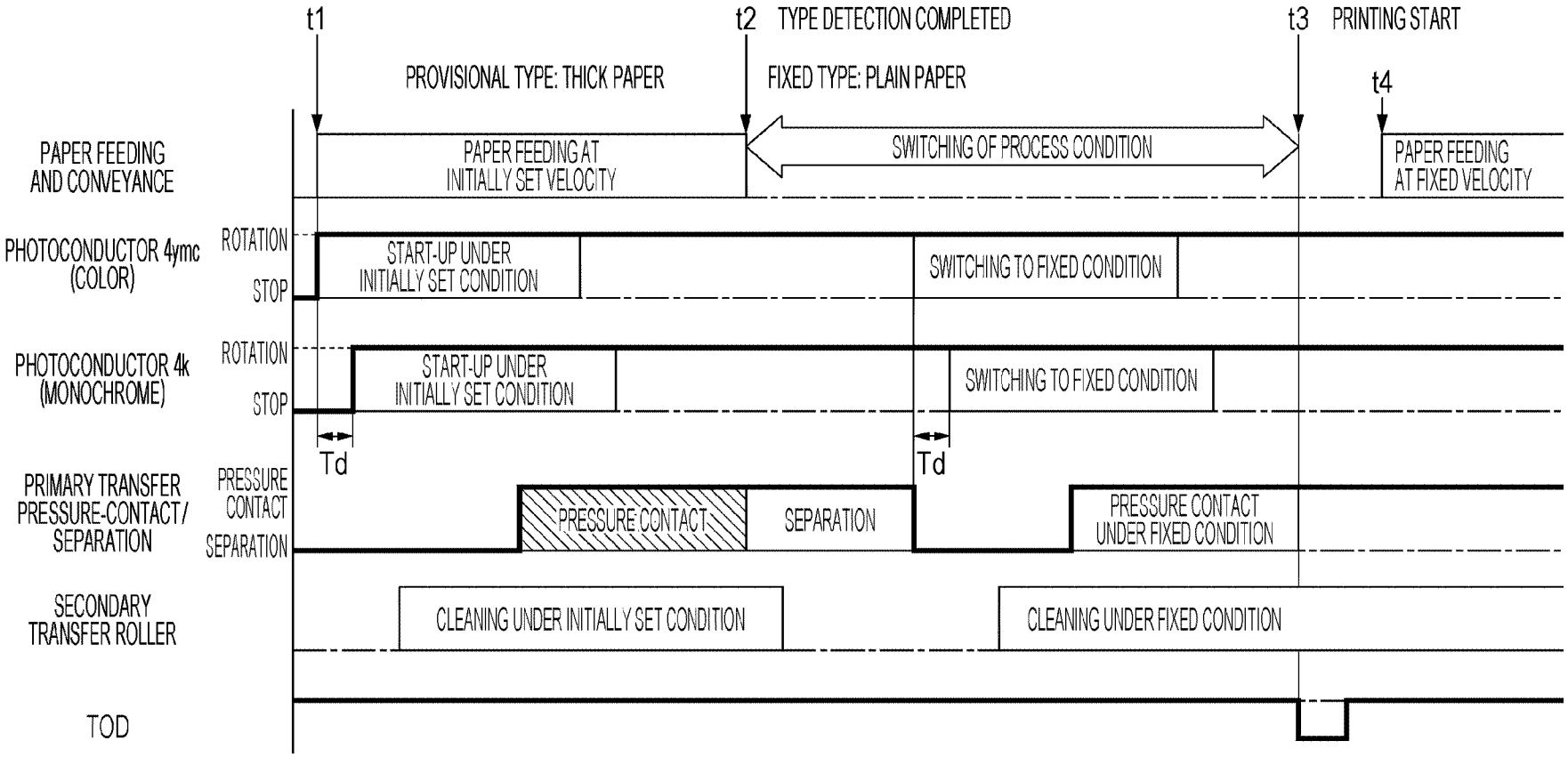
FIG. 13 illustrates a comparative example with respect to the second example in FIG. 12.
Figure 14:
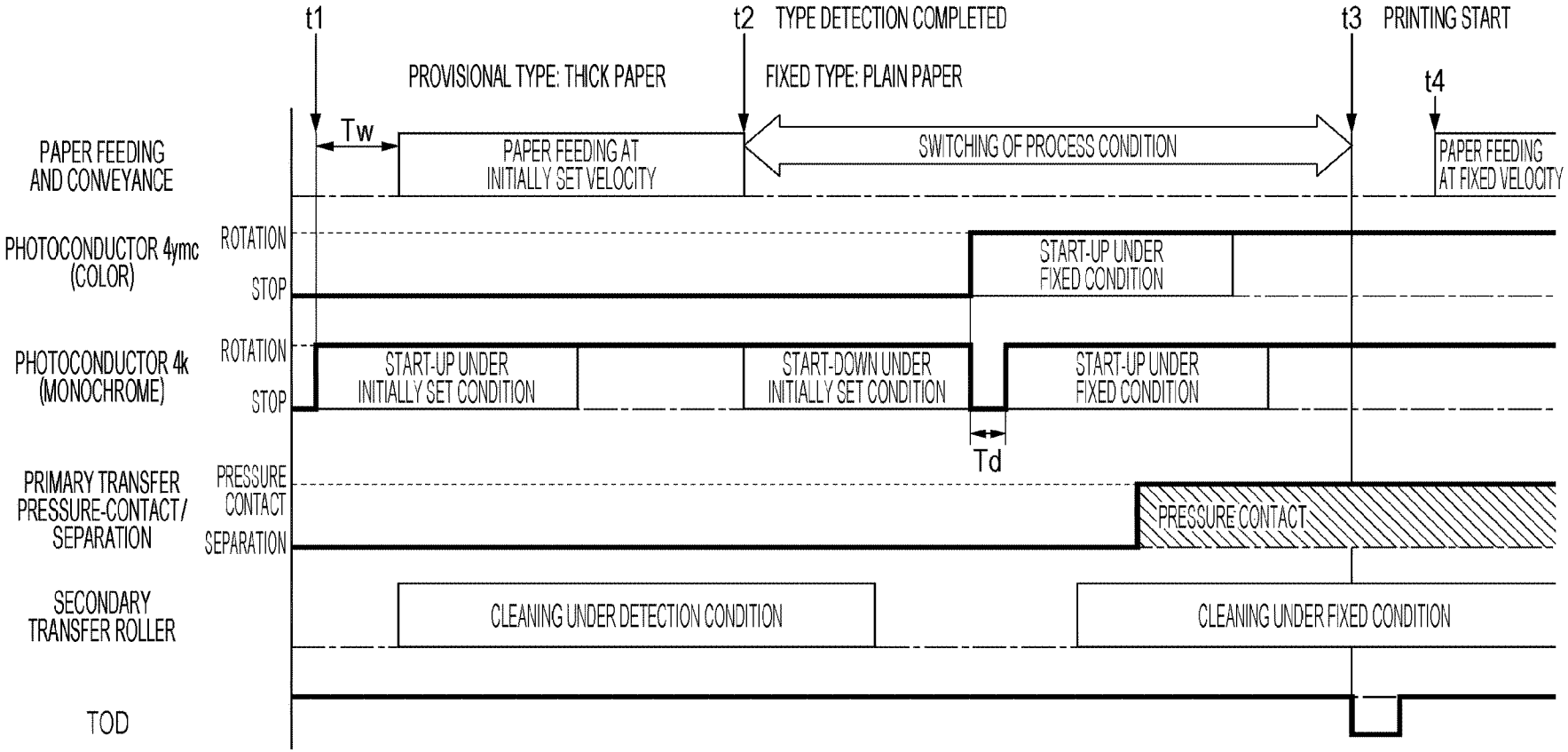
FIG. 14 illustrates the third example of the timing of the start-up control.
Figure 15:
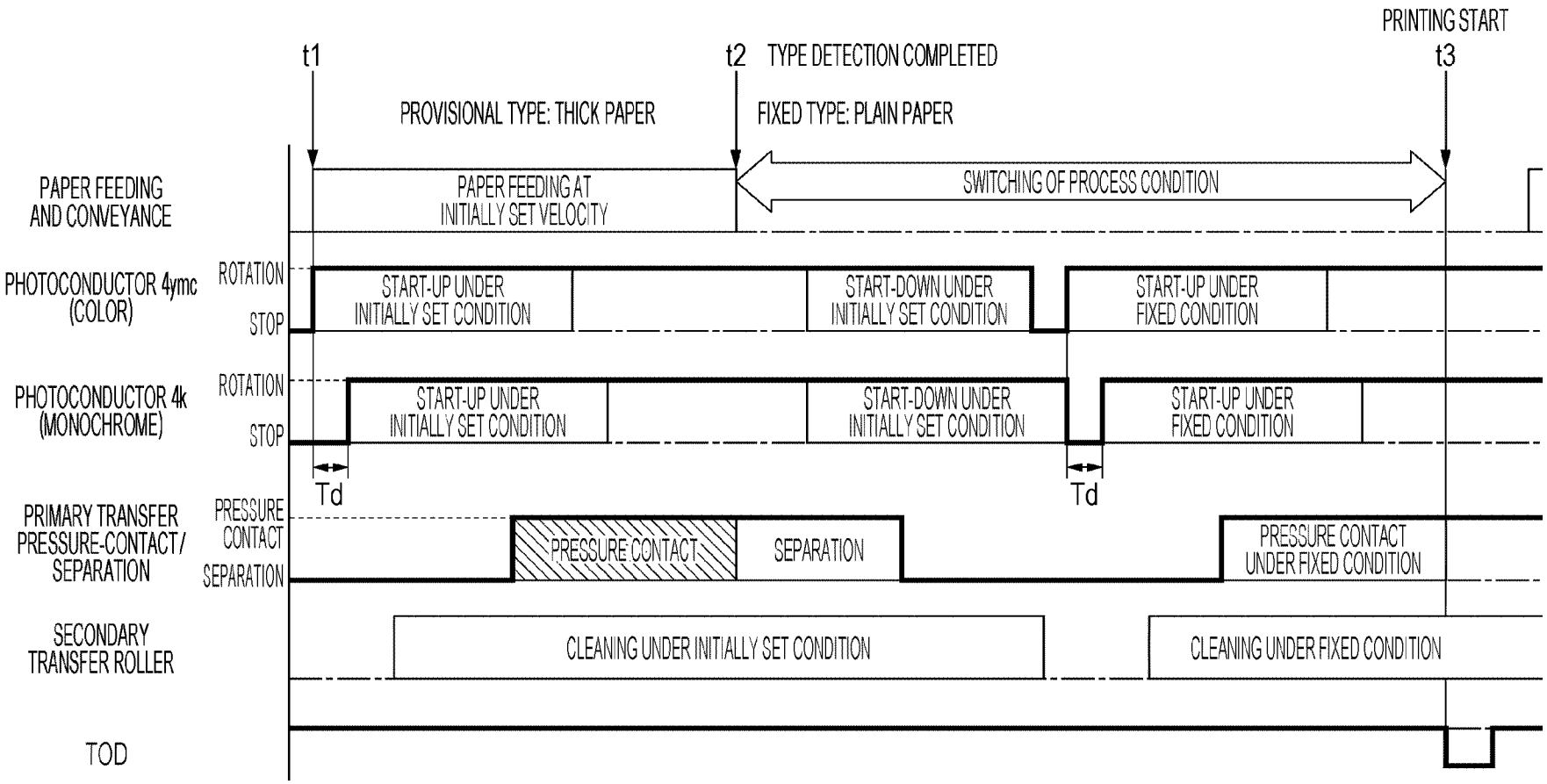
FIG. 15 illustrates a comparative example with respect to the third example in FIG. 14.

FIG. 11 illustrates a first example of the timing of the start-up control. FIG. 12 illustrates a second example of the timing of the start-up control. FIG. 13 illustrates a comparative example with respect to the second example in FIG. 12. FIG. 14 illustrates a third example of the timing of the start-up control. FIG. 15 illustrates a comparative example to the third example in FIG. 14.

The first example of FIG. 11 corresponds to the case where the relation β2 in FIG. 9 holds.

At timing t1, at which the start-up control is started, paper feeding at an initially set velocity is started. At timing t2, detection of the type Dk is completed.

During the period before condition fixing from the timing t1 to the timing t2, the state of pressure-contact/separation between the photoconductor 4 and the intermediate transfer belt 12 is kept in the separation. In addition, both of the color photoconductor 4*ymc* and the monochrome photoconductor 4*k* are kept in a stopped state.

At the timing t2, start-up of the color photoconductor 4*ymc* is started. Start-up of the monochrome photoconductor 4*k* is then started with a delay of a predetermined time Td. The delay of the time Td causes distribution of a load on power supplies of the high-voltage power supply circuit 250 and the motor.

After starting the start-up of the monochrome photoconductor 4*k*, cleaning (e g, elimination of electricity) of the secondary transfer roller 16 is started. The state of pressure-contact/separation is then switched from the separation to the pressure-contact.

An image request signal TOD is turned on toward the completion of shift to the rise state under the fixed condition. For example, the image formation controller 127 issues the image request signal TOD when a predetermined time has elapsed since the timing t2. At timing t3 when the image request signal TOD is turned on, the print head 6 starts printing (latent image formation by pattern exposure).

At timing t4, conveyance of the first sheet 2 from the timing roller 15 to the printing position P6 is started. The timing t4 has been waited so that an image formation region of the sheet 2 arrives upon arriving of a primarily transferred toner image at the printing position P6. The conveyance velocity corresponds to a velocity under the fixed condition.

The second example in FIG. 12 corresponds to the case where the relation β in FIG. 9 holds, that is, the case where the monochrome photoconductor 4*k* that applies to the relation β1 and the color photoconductor 4*ymc* that applies to the relation β2 are used.

At the timing t1, start-up of the monochrome photoconductor 4*k* under the initially set condition is started. The color photoconductor 4*ymc* is kept stopped.

The common monochrome PC motor 55 drives the monochrome photoconductor 4*k* and the paper feeding conveyor 231. After time Tw, which is required for stable rotation of the motor, has elapsed since the timing t1, feeding of the sheet 2 is started.

At the timing t2, the start-up of the color photoconductor 4*ymc* is started. With delay of only the time Td, switching of the velocity of the monochrome photoconductor 4*k* is then started. In addition, the operation condition of the secondary transfer roller 16 is switched. The state of pressure-contact/separation is then switched from the separation to the pressure contact at the appropriate time.

At the timing t3, printing is started. At the timing t4, conveyance of the sheet 2 to the printing position P6 is started.

In the comparative example in FIG. 13, the color photoconductor 4*ymc* and the monochrome photoconductor 4*k* are started up, and the state of pressure-contact/separation is put into the pressure contact during the period before condition fixing from the timing t1 to the timing t2 That is, the electrophotographic process is shifted to the rise state under the initially set condition.

As a result, after condition fixing, before the operation conditions of the photoconductors 4*ymc* and 4*k* are switched to the fixed condition, the state of pressure-contact/separation needs to be once switched to the separation in order to prevent rubbing against the intermediate transfer belt 12. The start of printing is thus delayed at least by the time required for switching to the separation.

According to the second example in FIG. 12, the separation is kept before condition fixing, so that switching to the separation before switching to the fixed condition is unnecessary. As a result, switching to the fixed condition can be started at the timing t2. The start of printing can be accelerated to make FPOT shorter than that in the comparative example. Moreover, a traditional art, in which toner is interposed between the photoconductor 4 and the intermediate transfer belt 12 to inhibit wear on these part, is unnecessary. Wasteful consumption of toner can be reduced.

The third example in FIG. 14 corresponds to the case where the monochrome photoconductor 4*k* that applies to the relation α1 in FIG. 9 and the color photoconductor 4*ymc* that applies to the relation β2 are used.

At the timing t1, start-up of the monochrome photoconductor 4*k* under the initially set condition is started. The color photoconductor 4*ymc* is kept stopped. In addition, the state of pressure-contact/separation of at least the color photoconductor 4*ymc* is kept in the separation.

At the timing t2, the monochrome photoconductor 4*k* is once started down. Once the rotation of the monochrome photoconductor 4*k* is stopped, the start-up of the color photoconductor 4*ymc* under the fixed condition is started before the monochrome photoconductor 4*k*. With delay of only the time Td, the start-up of the monochrome photoconductor 4*k* under the fixed condition is started. The reason why the color photoconductor 4*ymc* is started up first is that completion of the start-up earlier from a part having the top order of the primary transfer is advantageous in accelerating the start of printing.

In the comparative example in FIG. 15, as in the comparative example in FIG. 13, the color photoconductor 4*ymc* and the monochrome photoconductor 4*k* are started up, the state of pressure-contact/separation is put into the pressure contact, and the electrophotographic process is shifted to the rise state under the initially set condition, during the period before condition fixing.

As a result, after condition fixing, before the operation conditions of the photoconductors 4*ymc* and 4*k* are switched to the fixed condition, the state of pressure-contact/separation is once switched to the separation, whereby the start of printing is delayed by the time required for switching to the separation.

Figure 16:
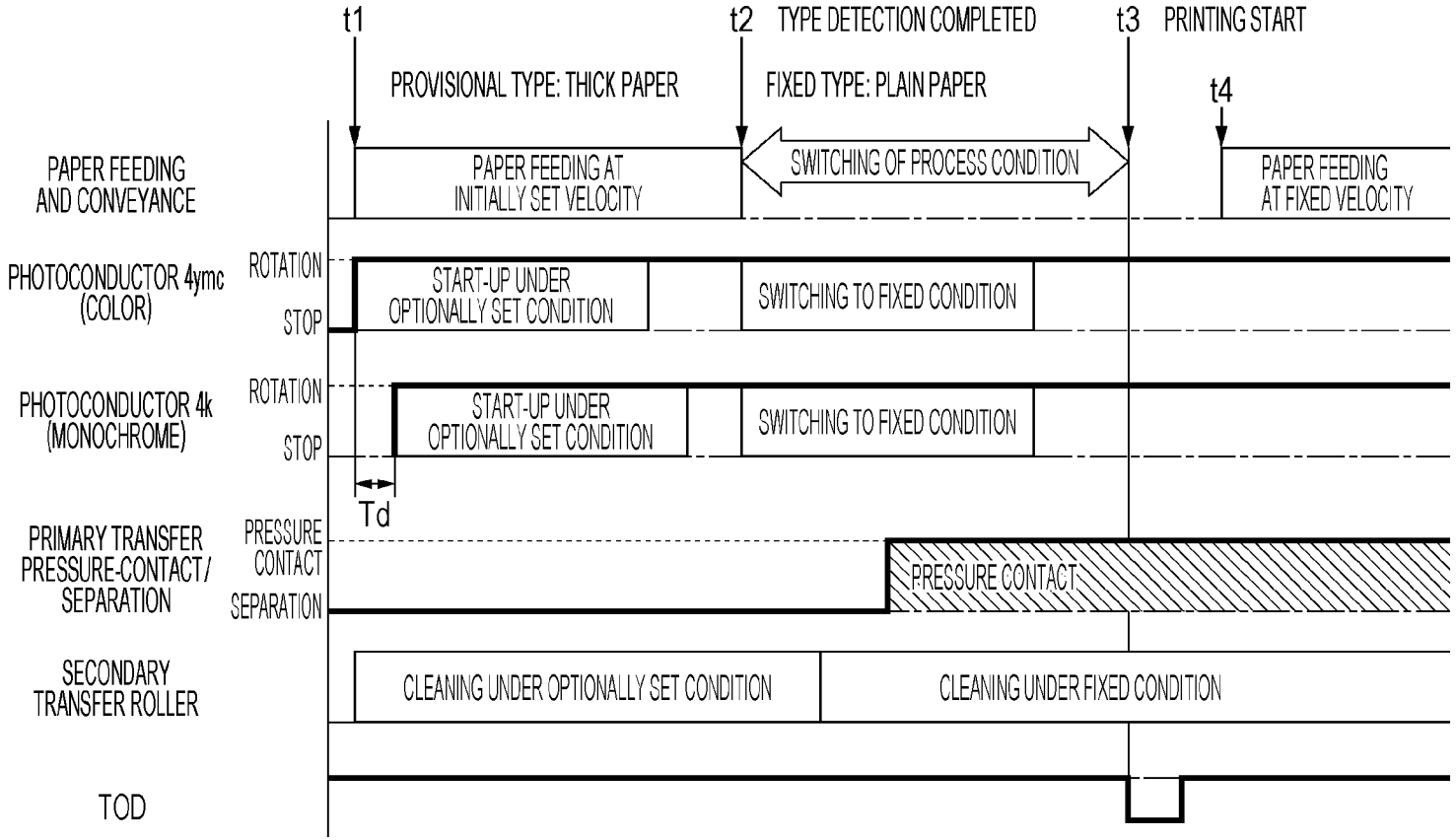
FIG. 16 illustrates the fourth example of the timing of the start-up control.
Figure 17:
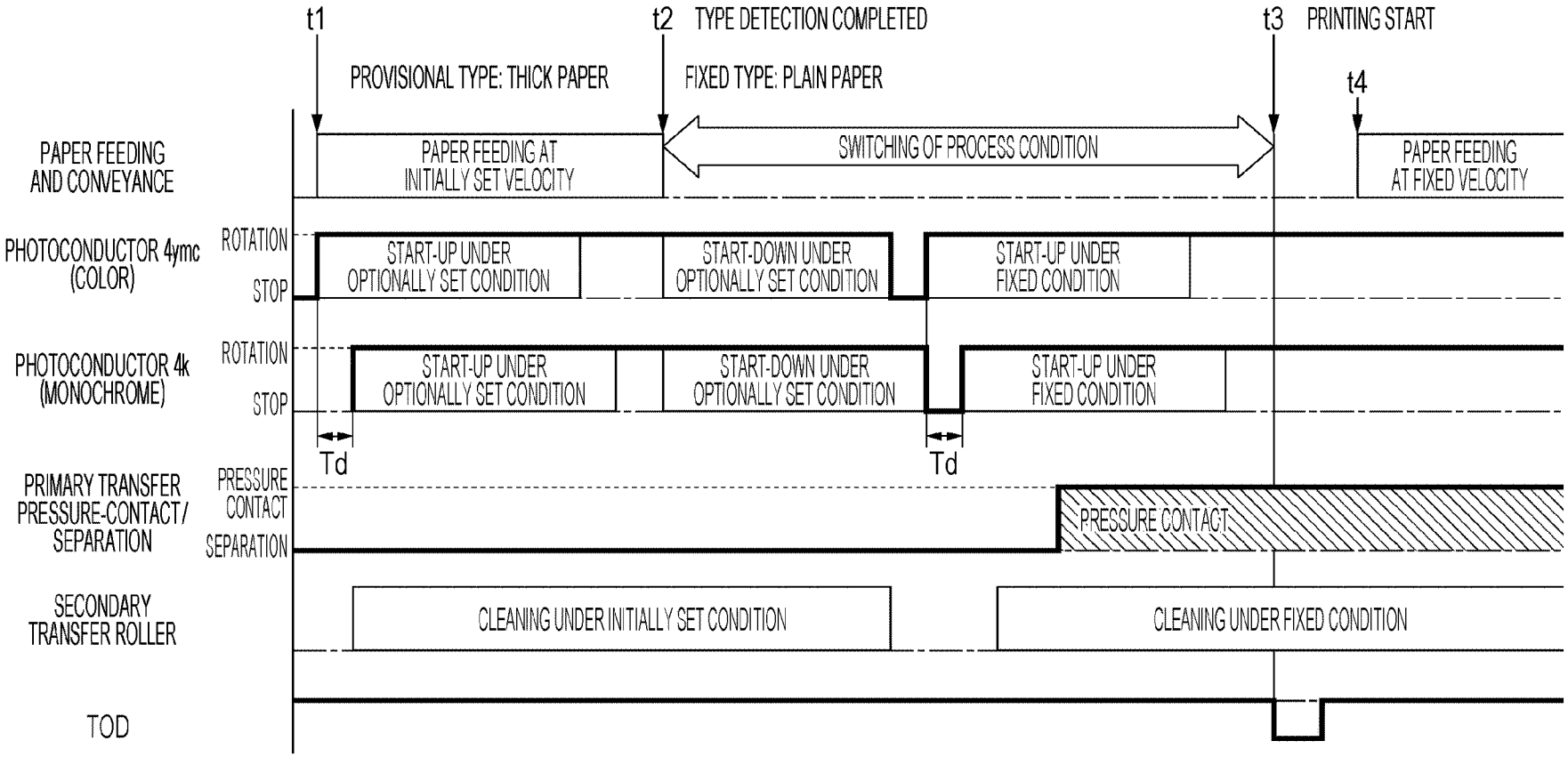
FIG. 17 illustrates the fifth example of the timing of the start-up control.
Figure 18:
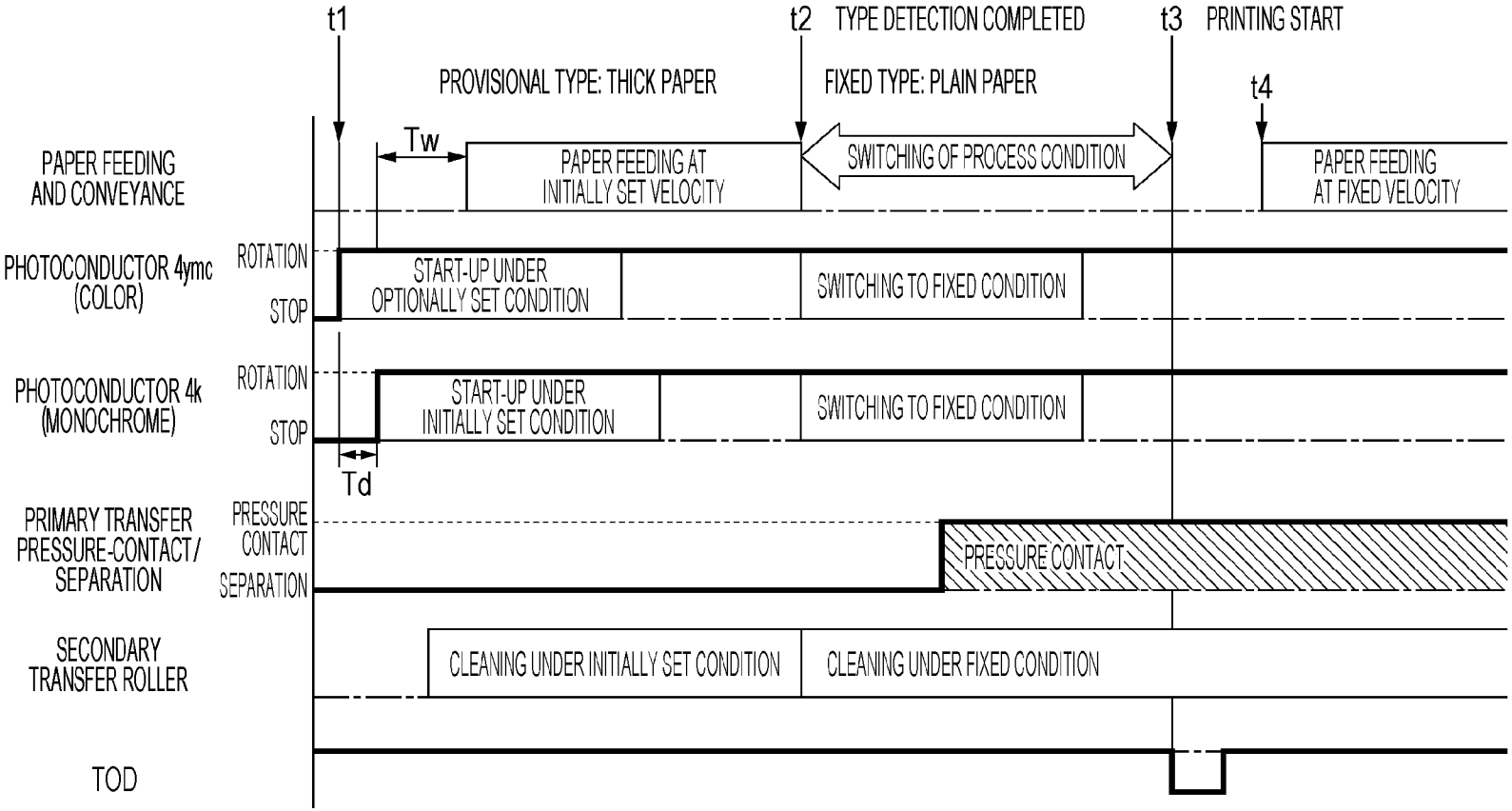
FIG. 18 illustrates the sixth example of the timing of the start-up control.
Figure 19:
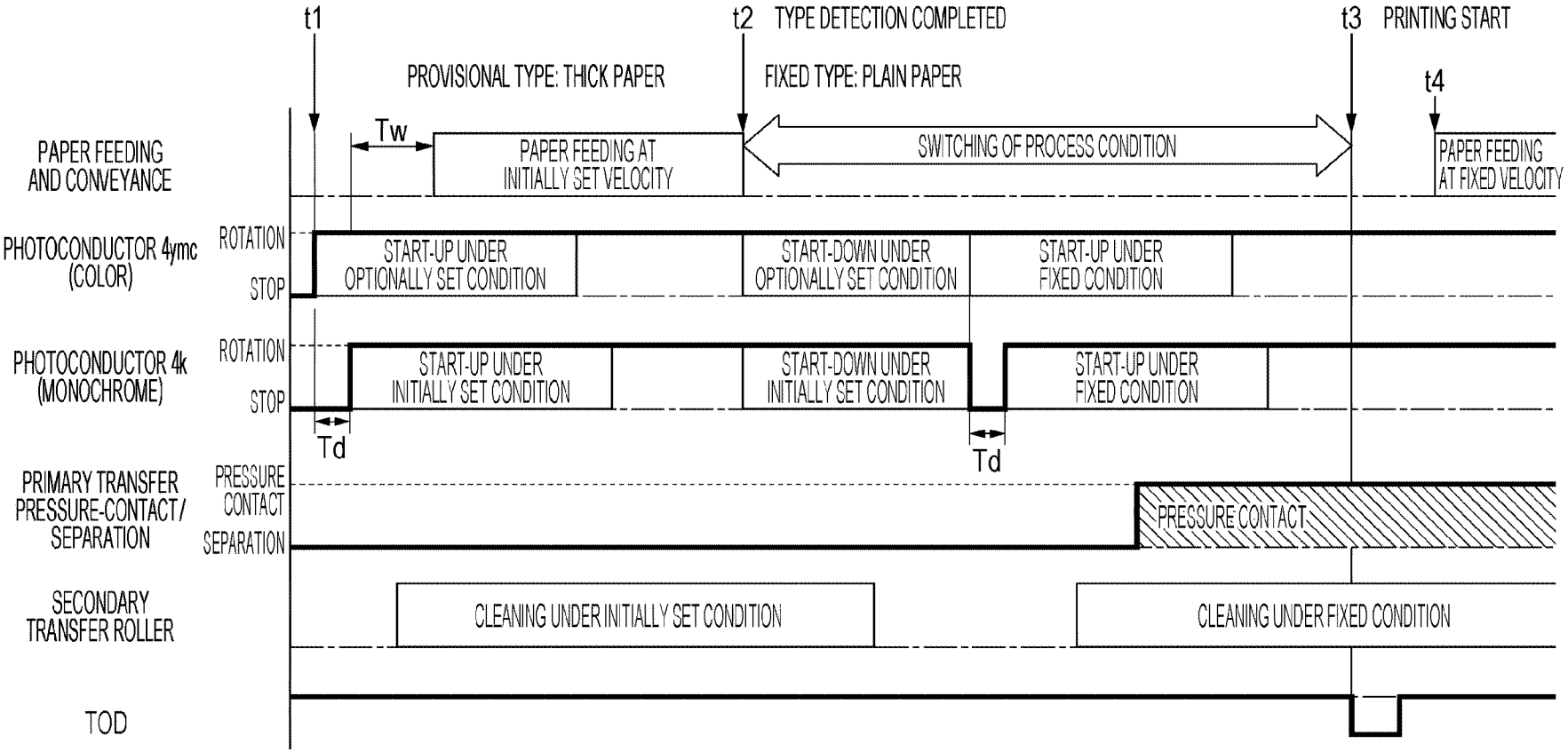
FIG. 19 illustrates the seventh example of the timing of the start-up control.
Figure 20:
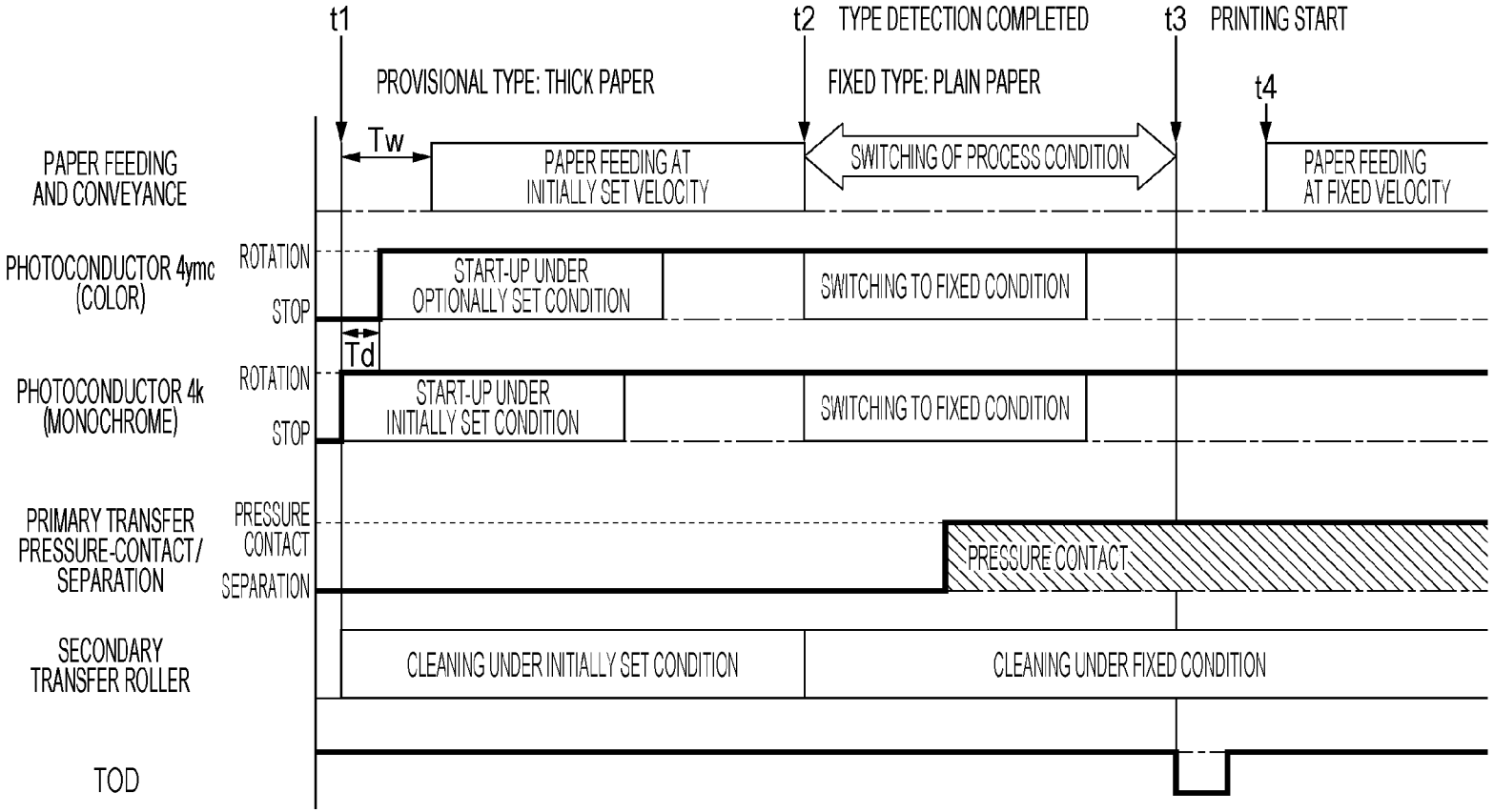
FIG. 20 illustrates the eighth example of the timing of the start-up control.
Figure 21:
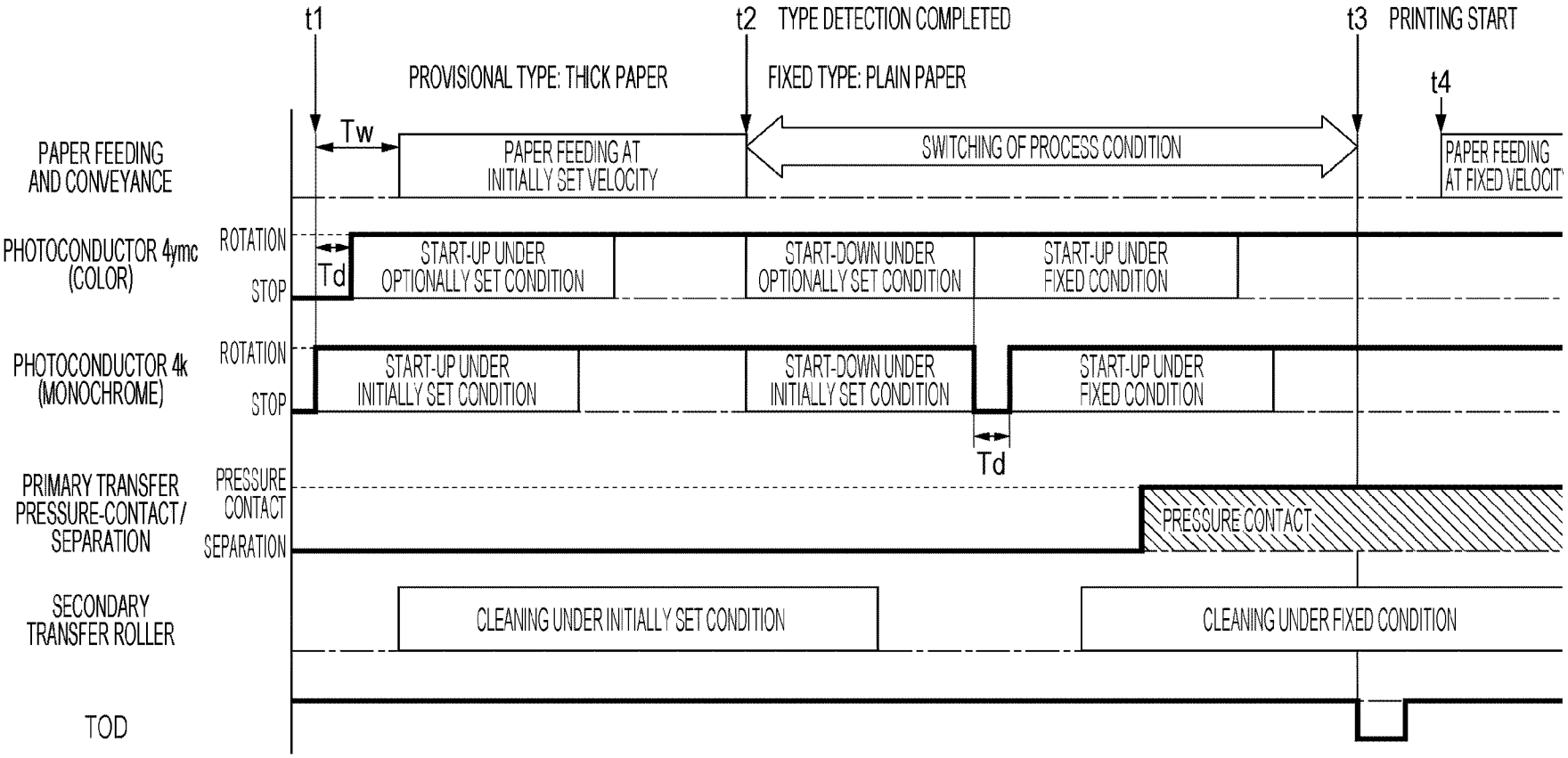
FIG. 21 illustrates the ninth example of the timing of the start-up control.

FIG. 16 illustrates the fourth example of the timing of the start-up control. FIG. 17 also illustrates the fifth example thereof. FIG. 18 also illustrates the sixth example thereof. FIG. 19 also illustrates the seventh example thereof. FIG. 20 also illustrates the eighth example thereof. FIG. 21 also illustrates the ninth example thereof.

The fourth example in FIG. 16 and the fifth example in FIG. 17 correspond to the case where the monochrome photoconductor 4*k* that applies to the relation α2 in FIG. 10 and the color photoconductor 4*ymc* that applies to the relation β2 are used.

In both of the fourth and fifth examples, the state of pressure-contact/separation is kept in the separation, and the color photoconductor 4*ymc* and the monochrome photoconductor 4*k* are shifted to the rise state under the optionally set condition, before condition fixing.

After condition fixing, the condition switching processing for switching the optionally set condition to the fixed condition is performed in the fourth example, and the restart-up processing for returning to the non-start-up state and start-up under the fixed condition is performed in the fifth example.

The sixth example in FIG. 18 and the seventh example in FIG. 19 correspond to the case where the monochrome photoconductor 4*k* that applies to the relation β1 in FIG. 10 and the color photoconductor 4*ymc* that applies to the relation β2 are used.

In both of the sixth and seventh examples, the state of pressure-contact/separation is kept in the separation, the color photoconductor 4*ymc* is shifted to the rise state under the optionally set condition, and the monochrome photoconductor 4*k* is shifted to the rise state under the initially set condition, before condition fixing. At the time, the color photoconductor 4*ymc* is started up earlier than the monochrome photoconductor 4*k*.

After condition fixing, the condition switching processing is performed in the sixth example, and the restart-up processing is performed in the seventh example.

The eighth example in FIG. 20 and the ninth example in FIG. 21 correspond to the case where the monochrome photoconductor 4*k* that applies to the relation α2 in FIG. 10 and the color photoconductor 4*ymc* that applies to the relation β2 are used.

In both of the eighth and ninth examples, the state of pressure-contact/separation is kept in the separation, the color photoconductor 4*ymc* is shifted to the rise state under the optionally set condition, and the monochrome photoconductor 4*k* is shifted to the rise state under the initially set condition, before condition fixing. At the time, the monochrome photoconductor 4*k* is started up earlier than the color photoconductor 4*ymc*.

After condition fixing, the condition switching processing is performed in the eighth example, and the restart-up processing is performed in the ninth example.

Generally, when the electrophotographic process is started up in the image forming apparatus including the intermediate transfer belt 12, the pressure contact of the intermediate transfer belt 12 cannot be performed unless fog toner attached at the time of start-up of the photoconductor 4 has passed through a primary transfer position. This is because stain on the back surface of the sheet 2 due to the fog toner needs to be prevented. In a low-price machine, the monochrome photoconductor 4*k* is constantly in pressure contact as in the configurations [1] and [2]. The timing when color toner passes through the primary transfer position corresponds to timing for starting the pressure contact of the intermediate transfer belt 12. This limits total process start-up time (substantial FPOT).

In the case of color printing, the color photoconductor 4*ymc* is first started up, and then the monochrome photoconductor 4*k* is started up after peak current dispersion time (Td) for a motor has elapsed. As a result, the timing when the color fog toner finishes passing through the primary transfer position is accelerated to shorten the FPOT.

When the type Dk of the sheet 2 is detected, however, a drive source related to conveyance is first driven in order to prioritize fixing of the type Dk. Accelerating the fixing of the type Dk can shorten the FPOT. That is, when the paper feeding conveyor 231 and the monochrome photoconductor 4*k* have a common drive source, the monochrome photoconductor 4*k* is first started up.

Figure 22:
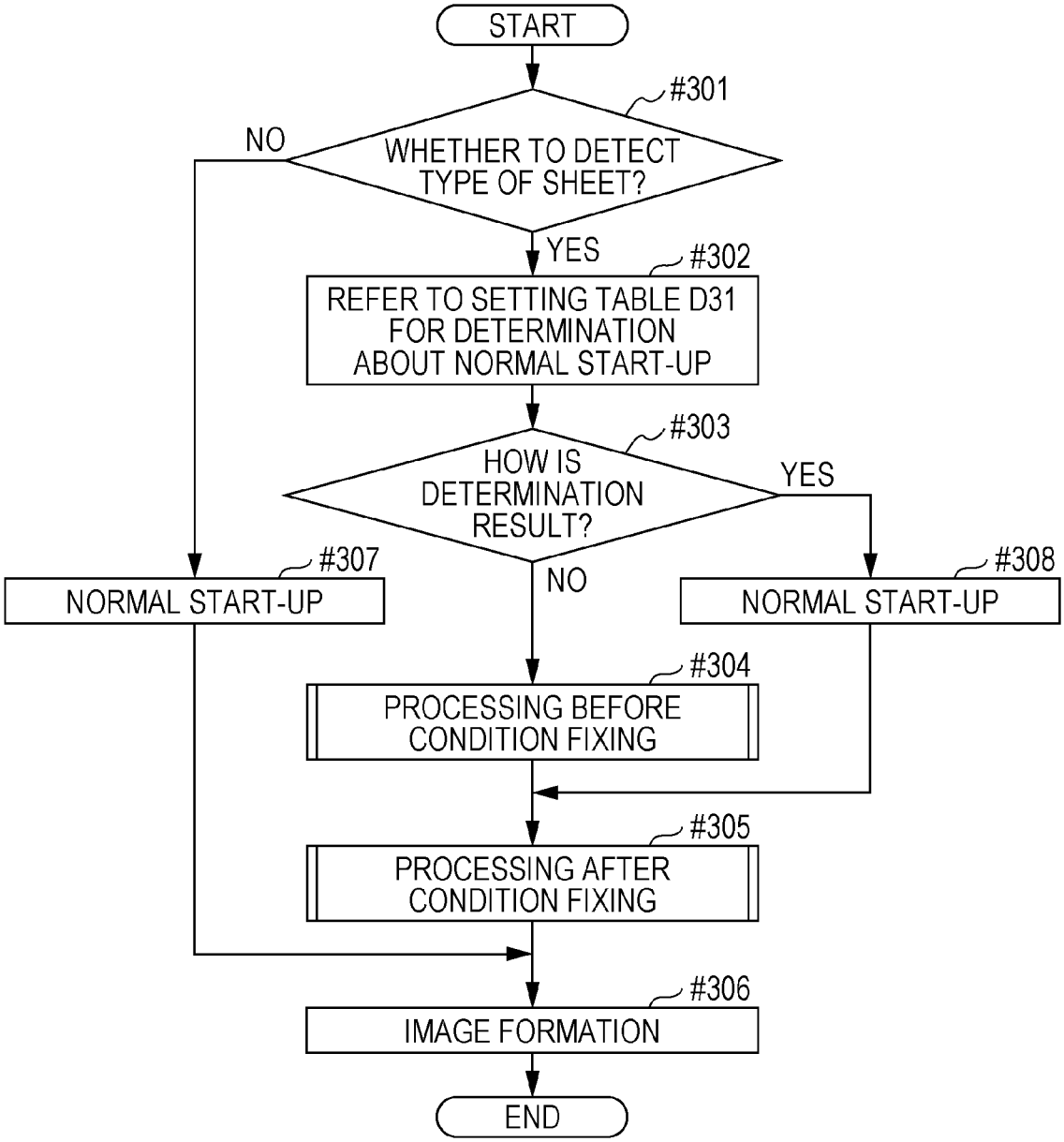
FIG. 22 illustrates a processing flow of the start-up control in the image forming apparatus.
Figure 23:
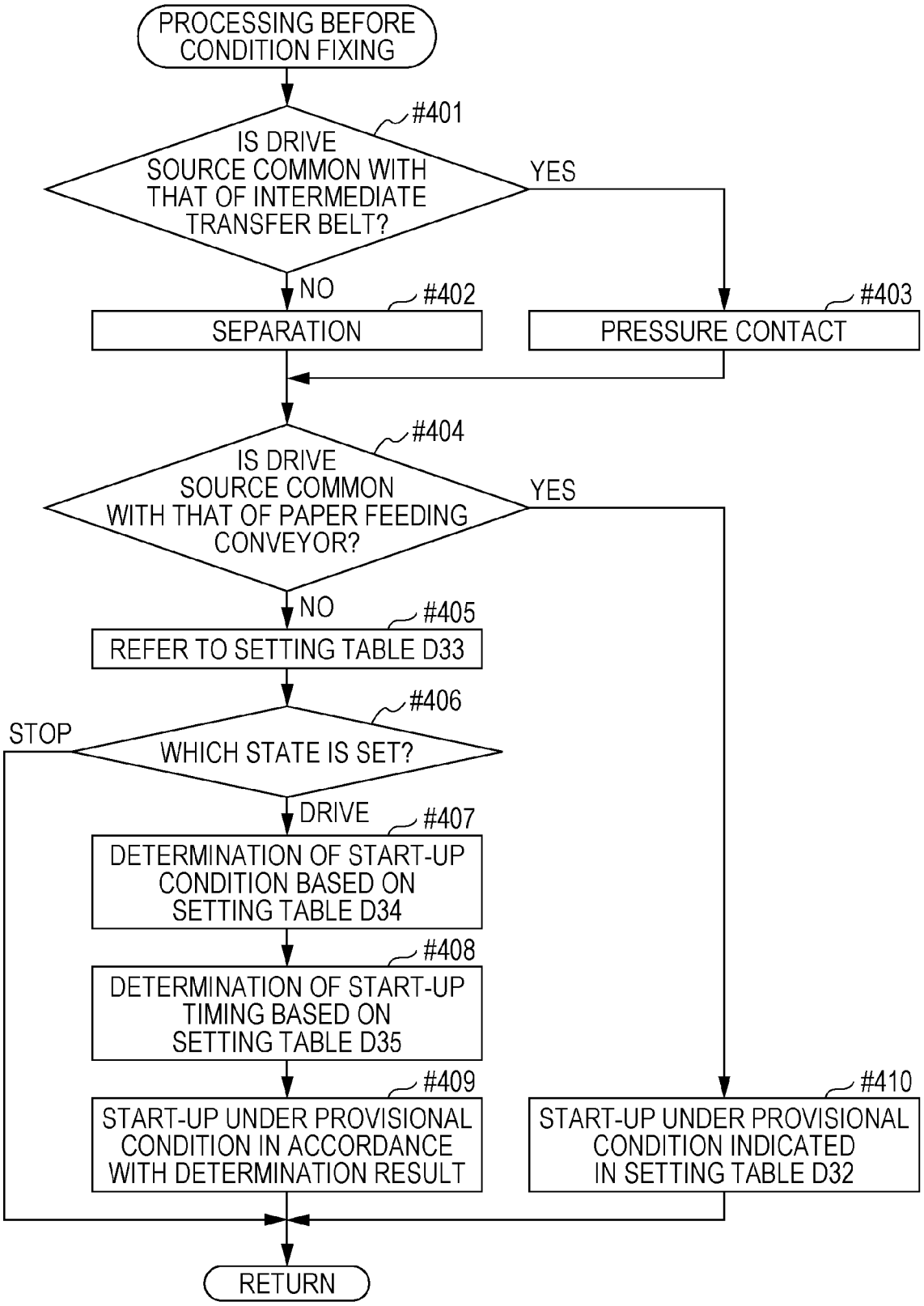
FIG. 23 illustrates a processing flow before condition fixing.
Figure 24:
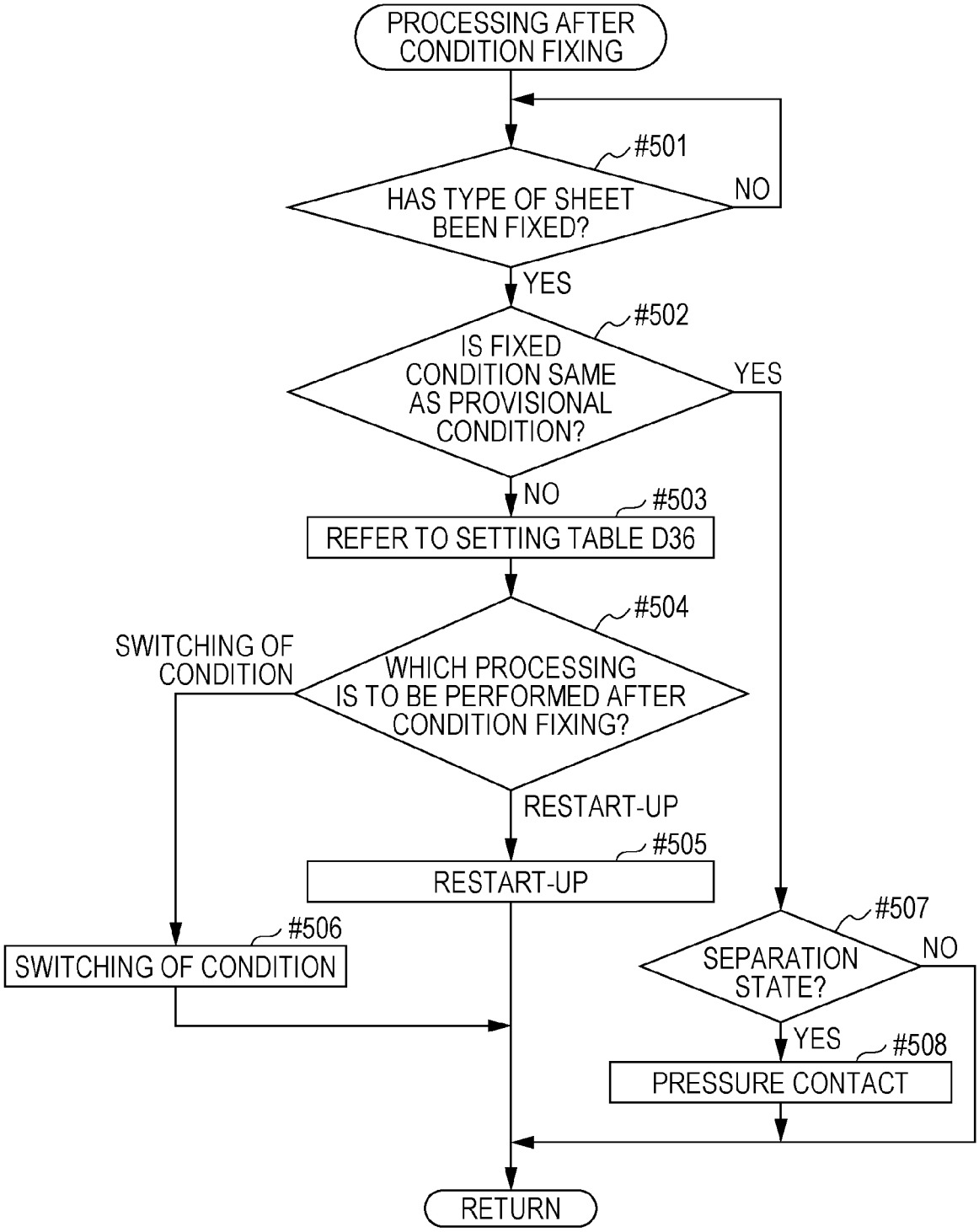
FIG. 24 illustrates a processing flow after the condition fixing.

FIG. 22 illustrates a processing flow of the start-up control in the image forming apparatus 1. FIG. 23 illustrates a processing flow before condition fixing. FIG. 24 illustrates a processing flow after condition fixing. FIGS. 25A, 25B, 26A to 26C, and 27 illustrate examples of setting tables D31 to D36 related to the start-up control, respectively.

The image forming apparatus 1 executes a series of pieces of processing illustrated in FIG. 22 in a print job. In the course of the processing, the image forming apparatus 1 determines the content of the start-up control in accordance with the relation between each of the intermediate transfer belt 12 and the paper feeding conveyor 231 and a drive source, for one or more of photoconductors 4 to be used in printing.

In FIG. 22, the image forming apparatus 1 first determines whether to detect the type Dk of the sheet 2 (#301). When the type Dk is stored as valid information for the selected tray 25, the image forming apparatus 1 determines not to perform detection. When the type Dk is not stored, the image forming apparatus 1 determines to perform detection.

When determining not to perform detection (NO in #301), the image forming apparatus 1 performs normal start-up (#307), in which direct shift from the non-rise state to the rise state under the fixed condition intentionally skipping the quasi-rise state. Immediately when the rise state is established, the image forming apparatus 1 starts printing (image formation) (#306). The fixed condition at the time corresponds to an operation condition corresponding to the stored type Dk.

When determining to detect the type Dk (YES in #301), the image forming apparatus 1 determines whether to perform the normal start-up with reference to the setting table D31 illustrated in FIG. 25A (#302 and #303).

The setting table D31 is provided for performing the normal start-up assuming the operation condition corresponding to the type Dk as the fixed condition when the type Dk having high use frequency is determined, and thereby shortening the FPOT. When a data amount indicating the number of use time for each type Dk is less than a threshold value and the reliability of the determination is insufficient, the setting table D31 indicates that the normal start-up is not performed. When the reliability is sufficient and the type Dk having high frequency exists, the setting table D31 indicates that the normal start-up is performed.

When determining to perform the normal start-up (YES in #303), the image forming apparatus 1 performs the normal start-up (#308), and proceeds to processing after condition fixing (#305) after performing the normal start-up. That is, when the operation condition corresponding to the type Dk having high use frequency among a plurality of assumed types Dk is defined as the provisional condition, the start-up controller 126 performs control for shift to a state where preparation for the image formation under the provisional condition has been completed, before the type Dk of the sheet 2 is detected. This control enables immediate start of printing without switching the operation condition when the provisional condition matches the true fixed condition corresponding to the detected type Dk. That is, the FOPT similar to that in the case where the type Dk is not detected can be achieved.

When determining not to perform the normal start-up (NO in #303), the image forming apparatus 1 sequentially performs processing (#304) before condition fixing and processing (#305) after condition fixing. The image forming apparatus 1 then forms an image (#306).

In the processing before condition fixing illustrated in FIG. 23, the image forming apparatus 1 first checks whether the photoconductor 4 of interest and the intermediate transfer belt 12 have a common drive source (#401).

When the photoconductor 4 of interest and the intermediate transfer belt 12 do not have a common drive source (NO in #401), the photoconductor 4 is separated from the intermediate transfer belt 12 (#402). When the photoconductor 4 of interest and the intermediate transfer belt 12 have a common drive source (YES in #401), the intermediate transfer belt 12 is brought into pressure contact with the photoconductor 4 (#403).

The image forming apparatus 1 then checks whether the photoconductor 4 of interest and the paper feeding conveyor 231 have a common drive source (#404).

When the photoconductor 4 of interest and the paper feeding conveyor 231 have the common drive source (YES in #404), the image forming apparatus 1 starts up the photoconductor 4 under the provisional condition set in the setting table D32 illustrated in FIG. 25B (#410).

The setting table D32 determines that, for example, thick paper has a conveyance velocity slower than plain paper in order to reduce the risk of jam, while matching the operation condition to the sheet 2 that is likely to be used by a user.

When the photoconductor 4 of interest and the paper feeding conveyor 231 does not have the common drive source (NO in #404), the image forming apparatus 1 checks whether setting of the state of the photoconductor 4 before condition fixing is stop or drive with reference to the setting table D33 illustrated in FIG. 26A (#405 and #406).

When the user specifies stop or drive, the setting table D33 defines the specified processing as the determination result. In addition, when the user specifies automatic, the setting table D33 defines one of stop and drive as the determination result in accordance with an environmental condition such as temperature and humidity, an endurance condition of whether the photoconductor 4 has reached the late stage of life, and use frequency of the type Dk. For example, when the use frequency has no regularity, the provisional condition and the fixed condition are highly likely not to match each other. For that reason, the determination result indicates stop in order to inhibit wasteful traveling.

When stop is set as a state before condition fixing, the image forming apparatus 1 immediately returns to the flow in FIG. 22.

In contrast, when drive is set as the state before condition fixing, the image forming apparatus 1 then determines a start-up condition and start-up timing with reference to the setting tables D34 and D35 illustrated in FIGS. 26B and 26C (#407 and #408). The image forming apparatus 1 then performs start-up under the provisional condition in accordance with the determined result (#409).

The setting table D34 is provided for determining the provisional condition in accordance with the reliability of determination on the use frequency of the type Dk. When the data amount indicating the number of use for each type Dk is equal to or more than a set amount (sufficient), the setting table D34 indicates that the operation condition corresponding to the type having high frequency is defined as the provisional condition. When the data amount is insufficient, the setting table D34 indicates that the initially set condition is defined as the provisional condition.

The setting table D35 defines processing to be performed so as to be completed substantially at the same time as completion of detection of the type Dk. For example, when the photoconductor 4 is driven by a single drive source that drives only the photoconductor 4, the setting table D35 indicates that completion timing of start-up of the photoconductor 4 and completion timing of detection of the type Dk are matched with each other. In addition, when the photoconductor 4 and a transfer mechanism have a common drive source, the setting table D35 indicates that completion timing of longer one of time required for the start-up of the photoconductor 4 and time required for transfer cleaning is matched to completion timing of detection of the type Dk. Control of timing in accordance with the content of the setting table D34 can minimize travel time of the photoconductor 4 and the intermediate transfer belt 12.

In the processing after condition fixing illustrated in FIG. 24, the image forming apparatus 1 waits for the type Dk of the sheet 2 to be detected for fixing the operation condition (#501). When the operation condition is fixed (YES in

#501), the image forming apparatus 1 determines whether the fixed condition is the same as the provisional condition (#502).

When the fixed condition is the same as the provisional condition (YES in #502) and the photoconductor 4 and the intermediate transfer belt 12 are separated from each other (YES in #507), the image forming apparatus 1 brings the photoconductor 4 and the intermediate transfer belt 12 into pressure contact with each other (#508), and returns to the flow in FIG. 22. When the photoconductor 4 and the intermediate transfer belt 12 are not separated from each other, the image forming apparatus 1 immediately returns to the flow in FIG. 22.

When the fixed condition is not the same as the provisional condition (NO in #502), the image forming apparatus 1 checks whether the setting after condition fixing corresponds to the condition switching processing or the restart-up processing with reference to the setting table D36 illustrated in FIG. 27 (#503 and #504). The image forming apparatus 1 performs the condition switching processing (#506) or the restart-up processing (#505) in accordance with the setting illustrated by the setting table D36.

When the user specifies the condition switching processing or the restart-up processing, the setting table D36 determines that the specified processing is performed. In addition, when the user specifies automatic, the setting table D36 determines which one of the condition switching processing and the restart-up processing is to be performed in accordance with an environmental condition such as temperature and humidity, and an endurance condition of whether the photoconductor 4 has reached the late stage of life.

According to the above-described embodiment, delay of start of printing in the case where the operation condition is switched after the start of start-up of the electrophotographic process can be reduced without wastefully consuming toner, which is coloring material serving as cushioning material for preventing wear due to deviated velocities of the photoconductor 4 and the intermediate transfer belt 12. That is, time for a user to wait for output of printed matter in the case where the type Dk is detected can be shortened.

The lives of the photoconductor 4 and a drive source of the photoconductor 4 is extended by the photoconductor 4 stopping the quasi-rise state before condition fixing. This configuration reduces cost per page (CPP).

In the improved start-up control, the state in the stage before condition fixing is not set to the rise state, but kept to the quasi-rise state. The improved start-up control can be performed not only in the color printing mode but in the monochrome printing mode, in which the single photoconductor 4*k* is used.

The items of the operation condition are not limited to the process velocity Vs, the fixing temperature Ts, the secondary transfer output V16, and the fog margin Vm. One or more of, for example, charging output, development output, an eraser light amount, primary transfer output, and an exposure light amount may be added. A plurality of items is not necessarily needed.

In the above-described embodiment, when the shift to the quasi-rise state includes start-up of the secondary transfer roller 16, cleaning for the secondary transfer roller 16 at the time of shift from the non-start-up state to the rise state can be omitted. In addition, when the secondary transfer roller 16 is rotated at the time of the shift to the quasi-rise state, the cleaning for the secondary transfer roller 16 can be omitted.

Although the media sensor 41 has been described as an optical sensor in the above description, the media sensor 41 may be a sensor of another type. For example, the media sensor 41 is required to be a sensor capable of detecting characteristics of paper, such as an ultrasonic sensor, a paper-thickness sensor, a camera, and a capacitance sensor. In addition, the media sensor 41 is not limited to a single sensor. The media sensor 41 may include a plurality of sensors (e.g., an optical sensor and an ultrasonic sensor). The ultrasonic sensor detects paper that is difficult to be detected by the optical sensor. The plurality of sensors thus enables detection of more paper types with high accuracy.

In addition, for example, the configuration of the entire image forming apparatus 1 or each part of the image forming apparatus 1, the content, order, or timing of the operation and processing, a classification method and the number of a plurality of assumed types Dk, and a specific value of the operation condition value Dc can be appropriately changed in accordance with the spirit of the invention.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus that forms an image on a sheet medium under an operation condition set in accordance with a type of the medium, the image forming apparatus comprising a hardware processor that:

detects which of a plurality of assumed types the type of the medium applies to, based on output from a sensor provided on a conveyance path for the medium; and performs control under which, before the type of the medium is detected, shift to a quasi-rise state, in which preparation for image formation under a provisional condition has partially been completed, is performed, the provisional condition corresponding to an operation condition corresponding to one of the plurality of assumed types, and after the type of the medium is detected, shift to a rise state, in which preparation for image formation under a fixed condition has been completed, is performed, the fixed condition corresponding to an operation condition corresponding to the detected type;

wherein the image forming apparatus further comprises:

a photoconductor that forms toner image corresponding to the image;

a first drive source that rotationally drives the photoconductor;

a transfer-receiving object to which the toner image is transferred from the photoconductor;

a second drive source that rotationally drives the transfer-receiving object; and a pressure-contact/separation mechanism that brings the photoconductor and the transfer-receiving object into pressure contact with each other and separates the photoconductor and the transfer-receiving object from each other, wherein, in the quasi-rise state, the photoconductor and the transfer-receiving object are separated from each other, and in the rise state, the photoconductor and the transfer-receiving object are in pressure contact with each other.

2. The image forming apparatus according to claim 1, wherein a drive source for conveying the medium is different from the first drive source, and in the quasi-rise state, the photoconductor and the transfer-receiving object are separated from each other, and the photoconductor is stopped.

3. The image forming apparatus according to claim 2, wherein the hardware processor starts preparation for image formation under the provisional condition so that shift to the quasi-rise state is finished at timing when the type of the medium is detected.

4. The image forming apparatus according to claim 1, wherein a drive source for conveying the medium is different from the first drive source, and in the quasi-rise state, the photoconductor and the transfer-receiving object are separated from each other, and the photoconductor is rotated at a velocity corresponding to one of a plurality of the operation conditions.

5. The image forming apparatus according to claim 4, wherein a rotation velocity of the photoconductor in the quasi-rise state corresponds to a velocity under an operation condition corresponding to a type having use frequency higher than a threshold value among the plurality of assumed types.

6. The image forming apparatus according to claim 5, wherein, when the use frequency is undetermined, the hardware processor defines the rotation velocity as a velocity under an initially set condition.

7. The image forming apparatus according to claim 1, wherein the first drive source doubles as a drive source for conveying the medium, and the hardware processor performs control for shift to the quasi-rise state in parallel with conveyance of the medium before the type of the medium is detected.

8. The image forming apparatus according to claim 1, wherein, before the type of the medium is detected, the hardware processor selects and performs one of control for keeping the photoconductor and the transfer-receiving object separated and keeping the photoconductor stopped and control for keeping the photoconductor and the transfer-receiving object separated and keeping the photoconductor rotating, in accordance with one of or a combination of more than one of user specification, an environmental condition, and an endurance condition.

9. The image forming apparatus according to claim 1, wherein, when the fixed condition is different from the provisional condition, the hardware processor switches the operation condition from the provisional condition to the fixed condition while rotating the photoconductor.

10. The image forming apparatus according to claim 1, wherein, when the fixed condition is different from the provisional condition, the hardware processor performs start-down control for returning the photoconductor to a non-start-up state immediately before starting of preparation for image formation under the provisional condition, and performs control for shift from the non-start-up state to the rise state.

11. The image forming apparatus according to claim 10, further comprising a transferring member that transfers the toner image from the transfer-receiving object to the medium, wherein, when shift to the quasi-rise state includes start-up of the transferring member, cleaning for the transferring member during shift from the non-start-up state to the rise state is omitted.

12. The image forming apparatus according to claim 1, wherein, when the fixed condition is different from the provisional condition, the hardware processor performs control of switching the operation condition from the provisional condition to the fixed condition while rotating the photoconductor and start-down control for returning the photoconductor to a non-start-up state immediately before starting of preparation for image formation under the provisional condition, and selects and performs one of the controls for shift from the non-start-up state to the rise state in accordance with one of or a combination of more than one of user specification, an environmental condition, and an endurance condition.

13. The image forming apparatus according to claim 1, further comprising a transferring member that transfers the toner image from the transfer-receiving object to the medium, wherein, when the transferring member is rotated during shift to the quasi-rise state, cleaning for the transferring member is omitted.

14. The image forming apparatus according to claim 1, wherein the provisional condition is determined in accordance with one of or a combination of more than one of user specification, use frequency of the type, and conveyance performance.

15. The image forming apparatus according to claim 1, wherein, when operation condition corresponding to a type having high use frequency among the plurality of assumed types is defined as the provisional condition, the hardware processor performs control for shift to a state where preparation for image formation under the provisional condition has been completed, before the type of the medium is detected.

16. An image forming apparatus that forms an image on a sheet medium under an operation condition set in accordance with a type of the medium, the image forming apparatus comprising a hardware processor that:

detects which of a plurality of assumed types the type of the medium applies to, based on output from a sensor provided on a conveyance path for the medium; and performs control under which, before the type of the medium is detected, shift to a quasi-rise state, in which preparation for image formation under a provisional condition has partially been completed, is performed, the provisional condition corresponding to an operation condition corresponding to one of the plurality of assumed types, and after the type of the medium is detected, shift to a rise state, in which preparation for image formation under a fixed condition has been completed, is performed, the fixed condition corresponding to an operation condition corresponding to the detected type;

wherein the image forming apparatus further comprises:

a photoconductor that forms toner image corresponding to the image;

a transfer-receiving object to which the toner image is transferred from the photoconductor;

a common drive source that rotationally drives both of the photoconductor and the transfer-receiving object; and a drive source that conveys the medium, wherein, in the quasi-rise state, the photoconductor and the transfer-receiving object are in pressure contact with each other, and both of the photoconductor and the transfer-receiving object are stopped, and in the rise state, the photoconductor and the transfer-receiving object are in pressure contact with each other, and both of the photoconductor and the transfer-receiving object are rotated.

17. An image forming apparatus that forms an image on a sheet medium under an operation condition set in accordance with a type of the medium, the image forming apparatus comprising a hardware processor that:

detects which of a plurality of assumed types the type of the medium applies to, based on output from a sensor provided on a conveyance path for the medium; and performs control under which, before the type of the medium is detected, shift to a quasi-rise state, in which preparation for image formation under a provisional condition has partially been completed, is performed, the provisional condition corresponding to an operation condition corresponding to one of the plurality of assumed types, and after the type of the medium is detected, shift to a rise state, in which preparation for image formation under a fixed condition has been completed, is performed, the fixed condition corresponding to an operation condition corresponding to the detected type;

wherein the image forming apparatus further comprises:

a first photoconductor that forms a first toner image corresponding to the image;

a second photoconductor that forms a second toner image corresponding to the image;

a transfer-receiving object to which the first toner image is transferred from the first photoconductor and the second toner image is transferred from the second photoconductor;

a first drive source that rotationally drives the first photoconductor;

a second drive source that rotationally drives both of the second photoconductor and the transfer-receiving object;

a third drive source that conveys the medium; and a pressure-contact/separation mechanism that brings the photoconductor and the transfer-receiving object into pressure contact with each other and separates the photoconductor and the transfer-receiving object from each other, wherein, in the quasi-rise state, the first photoconductor and the transfer-receiving object are separated, the second photoconductor and the transfer-receiving object are in pressure contact with each other, and both of the second photoconductor and the transfer-receiving object are stopped, and in the rise state, the second photoconductor and the transfer-receiving object are in pressure contact with each other, and both of the second photoconductor and the transfer- receiving object are rotated.

* * * * *